US012173479B2

(12) United States Patent
Shiratani et al.

(10) Patent No.: US 12,173,479 B2
(45) Date of Patent: Dec. 24, 2024

(54) SHOVEL, DISPLAY DEVICE FOR SHOVEL, AND CONTROL DEVICE FOR SHOVEL

(71) Applicant: SUMITOMO CONSTRUCTION MACHINERY CO., LTD., Tokyo (JP)

(72) Inventors: Ryuji Shiratani, Chiba (JP); Hajime Aragaki, Chiba (JP); Tomoki Kurokawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 297 days.

(21) Appl. No.: 17/655,443

(22) Filed: Mar. 18, 2022

(65) Prior Publication Data

US 2022/0205225 A1 Jun. 30, 2022

Related U.S. Application Data

(63) Continuation of application No. PCT/JP2020/036439, filed on Sep. 25, 2020.

(30) Foreign Application Priority Data

Sep. 26, 2019 (JP) ..... 2019-176158

(51) Int. Cl.
*E02F 9/26* (2006.01)

(52) U.S. Cl.
CPC ..... *E02F 9/264* (2013.01)

(58) Field of Classification Search
CPC ..... E02F 9/264; E02F 9/0858; E02F 9/207; E02F 3/435; E02F 3/437; E02F 3/965; E02F 9/2282; E02F 9/2285; E02F 9/2292; E02F 9/2296; E02F 3/28; E02F 3/36; E02F 9/00; E02F 9/08; E02F 9/16; E02F 9/20; E02F 9/2058; E02F 9/22; E02F 9/2267; E02F 9/26; E02F 9/265; E02F 9/2025; E02F 9/2203; B60Y 2200/412
See application file for complete search history.

(56) References Cited

U.S. PATENT DOCUMENTS

| | | | | |
|---|---|---|---|---|
| 5,822,891 | A | 10/1998 | Fujishima et al. | |
| 2014/0354813 | A1* | 12/2014 | Ishimoto | G06T 11/60 348/148 |
| 2018/0030694 | A1 | 2/2018 | Kanari et al. | |
| 2018/0305902 | A1 | 10/2018 | Tsukamoto | |

(Continued)

FOREIGN PATENT DOCUMENTS

| | | |
|---|---|---|
| EP | 3521517 | 8/2019 |
| EP | 3779054 | 2/2021 |

(Continued)

OTHER PUBLICATIONS

International Search Report for PCT/JP2020/036439 mailed on Dec. 15, 2020.

*Primary Examiner* — Mary Cheung
(74) *Attorney, Agent, or Firm* — IPUSA, PLLC

(57) ABSTRACT

A shovel includes a lower travel body, an upper swivel body that is swingably installed on the lower travel body, an attachment that is installed on the upper swivel body, and a posture detecting device that detects a posture of the attachment, wherein a virtual plane is generated by utilizing information about a position of a predetermined portion of the attachment obtained from an output of the posture detecting device.

16 Claims, 21 Drawing Sheets

(56) References Cited

U.S. PATENT DOCUMENTS

| | | | |
|---|---|---|---|
| 2019/0017249 | A1 | 1/2019 | Uji et al. |
| 2019/0338494 | A1 | 11/2019 | Moriki et al. |

FOREIGN PATENT DOCUMENTS

| | | | |
|---|---|---|---|
| JP | H09-177115 | | 7/1997 |
| JP | 2000-179008 | | 6/2000 |
| JP | 2008-121280 | | 5/2008 |
| JP | 2009228249 | A * | 10/2009 |
| JP | 2011-001775 | | 1/2011 |
| JP | 2013-151830 | | 8/2013 |
| JP | 2016-089389 | | 5/2016 |
| JP | 2016-204840 | | 12/2016 |
| JP | 2017-180712 | | 10/2017 |
| JP | 2018-044415 | | 3/2018 |
| JP | 2019-039182 | | 3/2019 |
| JP | 2019-132062 | | 8/2019 |

* cited by examiner

SHOVEL, DISPLAY DEVICE FOR SHOVEL, AND CONTROL DEVICE FOR SHOVEL

CROSS-REFERENCE TO RELATED APPLICATIONS

The present application is a continuation application of International Application No. PCT/JP2020/036439, filed Sep. 25, 2020, which claims priority to Japanese Patent Application No. 2019-176158, filed Sep. 26, 2019. The contents of these applications are incorporated herein by reference in their entirety.

BACKGROUND

Technical Field

The present disclosure relates to a shovel as an excavator.

Description of Related Art

Conventionally, a backhoe having a function to regulate a swivel action is known. The backhoe is configured to stop the swivel action when the swivel part enters within a preset swivel prohibited range.

SUMMARY

Even when the above backhoe enters into the swivel prohibited range, an action that is other than a swivel action such as bucket opening and closing actions of the bucket and a travelling action shall not be stopped. In addition, in order to implement such a function, an operator must set an action prohibited range such as a swivel prohibited range around the backhoe, and if setting work is complicated, there is a risk that the operator may hesitate to use such a function.

Therefore, it is desirable to provide a shovel that can easily generate a virtual plane that can be used for various usages.

A shovel includes a lower travel body, an upper swivel body that is swingably installed on the lower travel body, an attachment that is installed on the upper swivel body, and a posture detecting device that detects a posture of the attachment, wherein a virtual plane is generated by utilizing information about a position of a predetermined portion of the attachment obtained from an output of the posture detecting device.

Effects of the Invention

The above-described means provide a shovel that can easily generate virtual planes that can be used for various types of usage.

DETAILED DESCRIPTION

Figure 1A:
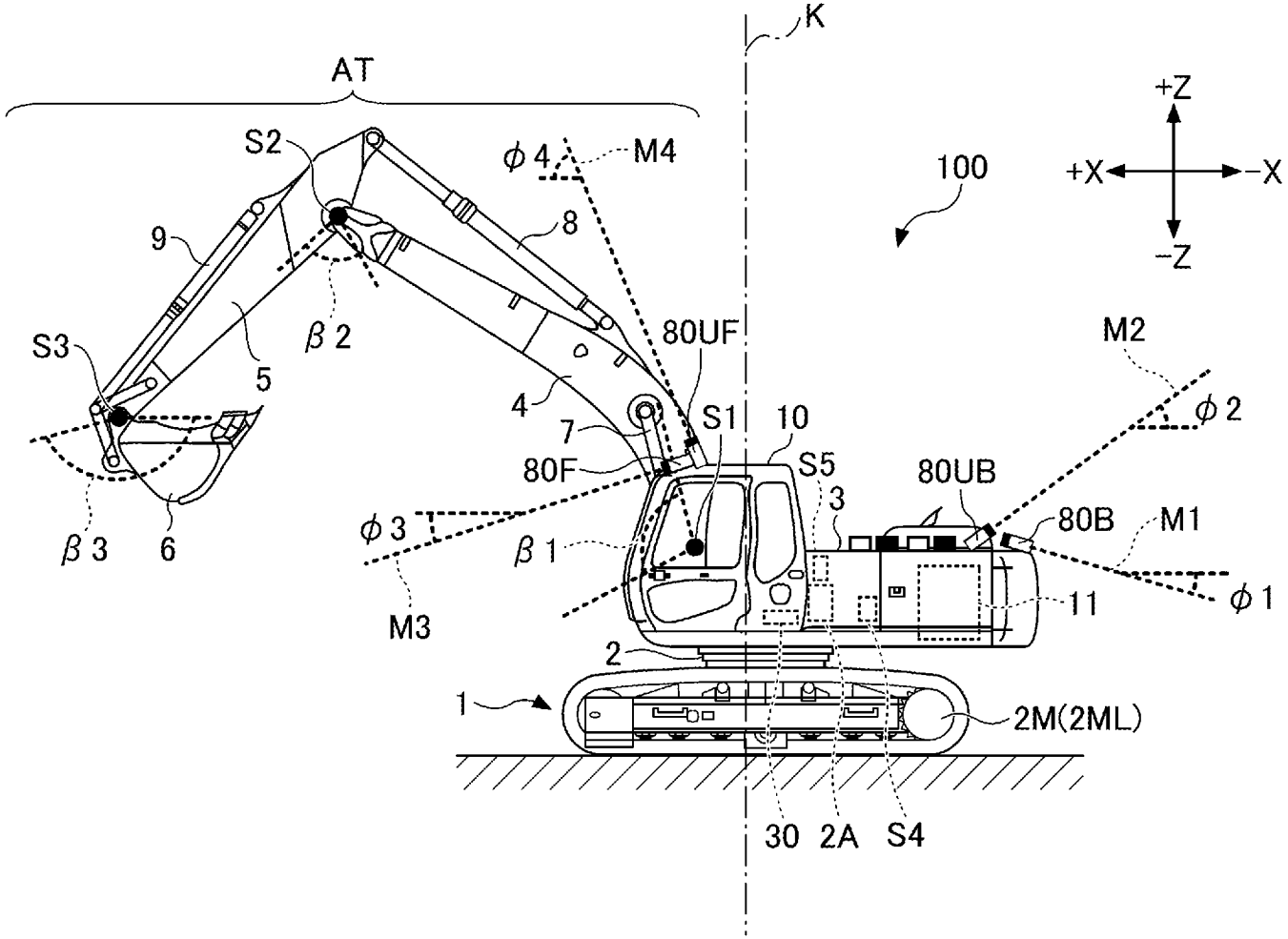
FIG. 1A is a side view of a shovel.
Figure 1B:
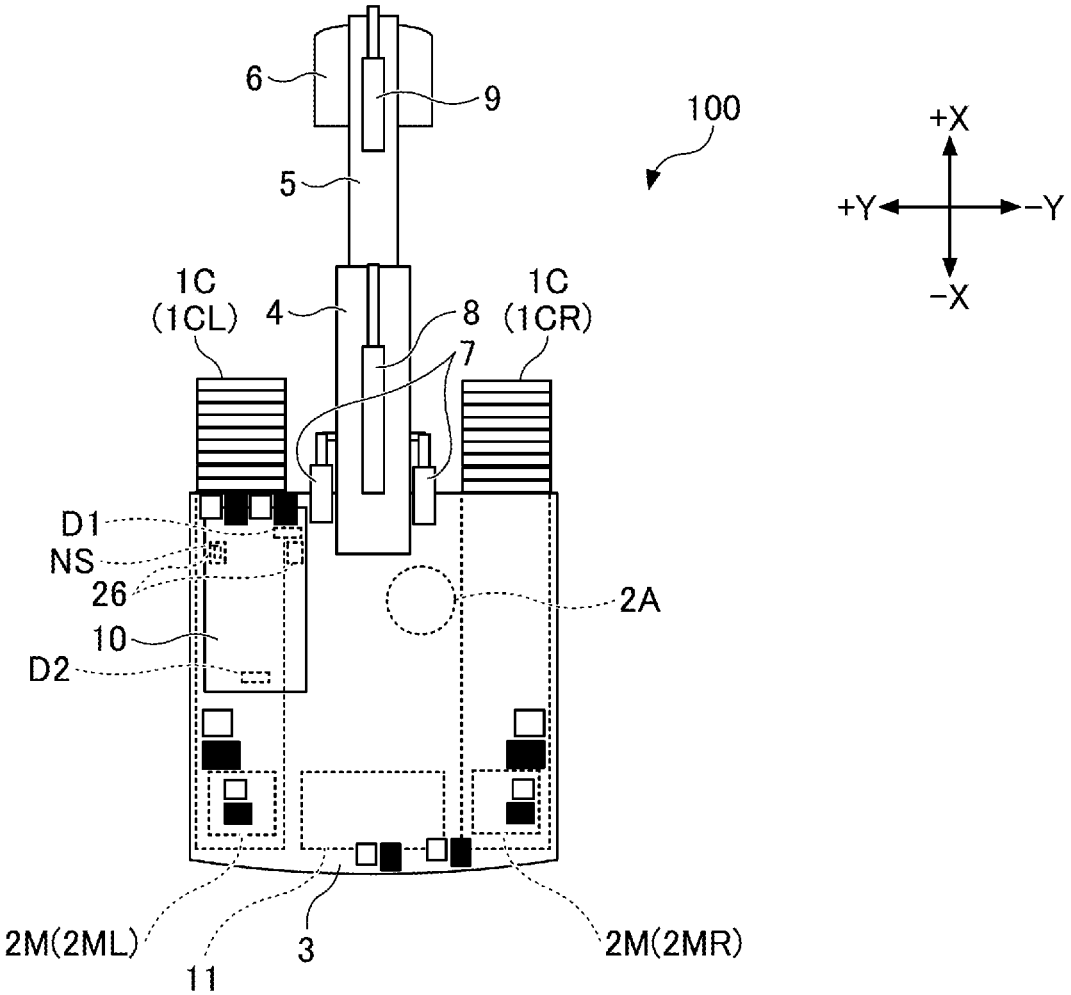
FIG. 1B is a top view of the shovel.
Figure 1C:
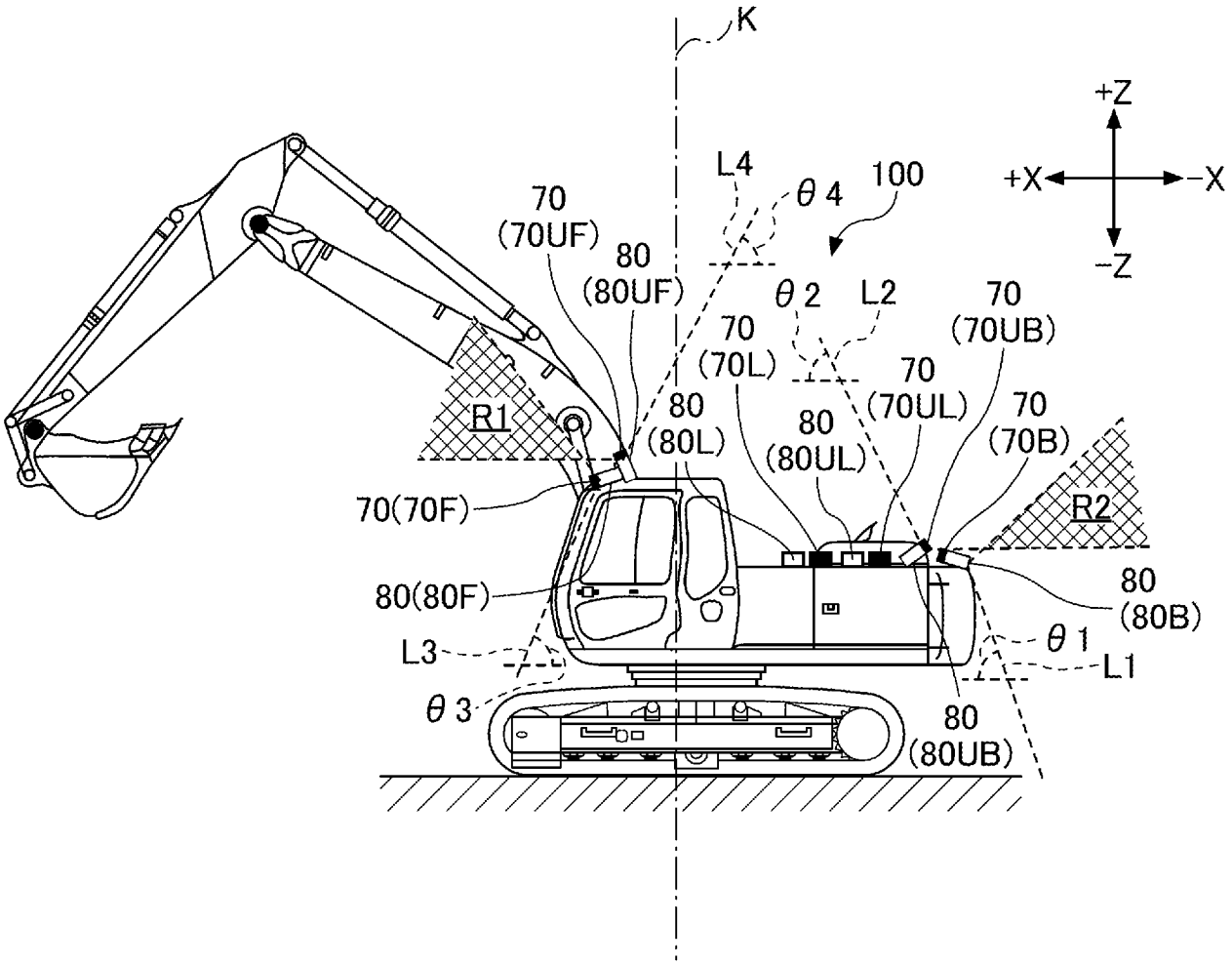
FIG. 1C is another side view of the shovel.
Figure 1D:
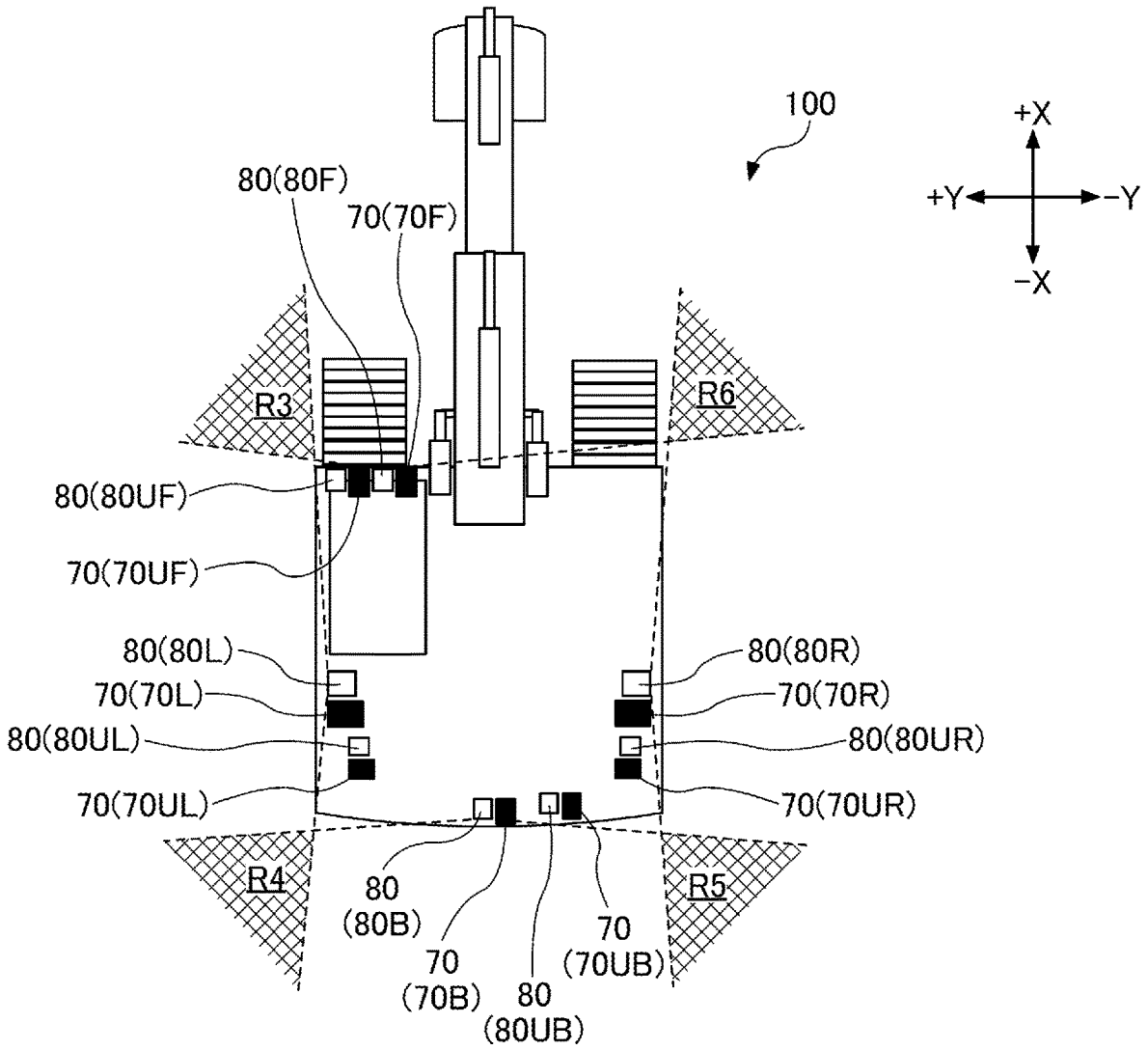
FIG. 1D is another top view of a shovel.

First, a shovel 100 as an excavator according to an embodiment of the present invention will be described with reference to FIGS. 1A-1D. FIGS. 1A and 1C illustrate side views of the shovel 100. FIGS. 1B and 1D illustrate top views of the shovel 100. FIG. 1A is the same diagram as FIG. 1C, except for reference symbols and auxiliary lines, and FIG. 1B is the same diagram as FIG. 1D, except for reference symbols and auxiliary lines.

In this embodiment, a hydraulic actuator is installed on the shovel 100. The hydraulic actuator includes a left travel hydraulic motor 2ML, a right travel hydraulic motor 2MR, a swivel hydraulic motor 2A, a boom cylinder 7, an arm cylinder 8, and a bucket cylinder 9.

The lower travel body 1 of the shovel 100 includes a crawler 1C. The crawler 1C is driven by the travel hydraulic motor 2M installed on the lower travel body 1. Specifically, the crawler 1C includes a left crawler 1CL and a right crawler 1CR. The left crawler 1CL is driven by the left travel hydraulic motor 2ML and the right crawler 1CR is driven by the right travel hydraulic motor 2MR.

The upper swivel body 3 is installed on the lower travel body 1 through the swivel mechanism 2 so as to be swingable. The swivel mechanism 2 is driven by a swivel hydraulic motor 2A installed on the upper swivel body 3. However, the swivel hydraulic motor 2A may be a swivel motor generator as an electromotive actuator.

A boom 4 is attached to the upper swivel body 3. An arm 5 is attached to the front end of the boom 4, and a bucket 6 as an end attachment is attached to the front end of the arm 5. The boom 4, the arm 5, and the bucket 6 form an excavation attachment AT as an example of an attachment. The boom 4 is driven by a boom cylinder 7 and the arm 5 is driven by an arm cylinder 8. The bucket 6 is driven by a bucket cylinder 9.

The boom 4 is rotatably supported relative to the upper swivel body 3. The boom angle sensor S1 is installed on the boom 4. The boom angle sensor S1 can detect a boom angle β1, which is the rotation angle of the boom 4. The boom angle β1 is, for example, the angle of rise from the state where the boom 4 is lowered most. Therefore, the boom angle β1 is maximized when the boom 4 is raised to the maximum.

The arm 5 is rotatably supported relative to the boom 4. An arm angle sensor S2 is installed on the arm 5. The arm angle sensor S2 can detect the arm angle β2, which is the rotation angle of the arm 5. The arm angle β2 is, for example, the angle of stretching out from the completely folded position of the arm 5. Therefore, the arm angle β2 is maximized when the arm 5 is stretched out most.

The bucket 6 is rotatably supported relative to the arm 5. A bucket angle sensor S3 is installed on the bucket 6. The bucket angle sensor S3 can detect a bucket angle β3, which is the rotation angle of the bucket 6. The bucket angle β3 is the angle of opening the bucket 6 from its most closed position. Therefore, the bucket angle β3 is maximized when the bucket 6 is opened most.

In the embodiment of FIG. 1, the boom angle sensor S1, the arm angle sensor S2, and the bucket angle sensor S3 each is formed with a combination of an acceleration sensor and a gyro sensor. However, at least one from the boom angle sensor S1, the arm angle sensor S2, and the bucket angle sensor S3 may be foiled only with the acceleration sensor. The boom angle sensor S1 may be a stroke sensor installed on the boom cylinder 7, a rotary encoder, a potentiometer, an inertia measuring device, or the like. The same applies to the arm angle sensor S2 and the bucket angle sensor S3.

The upper swivel body 3 is provided with a cabin 10 as an operator's cab and a power source such as an engine 11 is mounted thereon. Further, an object detection device 70, an image capturing device 80, a body tilt sensor S4, and a swivel angle speed sensor S5 are installed on the upper swivel body 3. The inside of the cabin 10 includes an operation device 26, a controller 30, a display device D1, a sound output device D2, and the like. For the sake of convenience, the side where the excavation attachment AT is installed on the upper swivel body 3 is defined as a front side, and the side where a counterweight is mounted is defined as a back side.

The object detection device 70 illustrated in FIGS. 1C and 1D are an example of an ambient monitoring device (space recognition device) and is configured to detect an object present around the shovel 100. The object is, for example, a person, an animal, a vehicle, a construction machine, a structure, a wall, fences, a hole, and so on. The object detection device 70 may be, for example, a camera, an ultrasonic sensor, a millimeter wave radar, a stereo camera, a LIDAR, a distance image sensor, or an infrared sensor. In this embodiment, the object detection device 70 includes a back sensor 70B and an upper back sensor 70UB that are LIDAR installed on the upper back end of the upper swivel body 3, a front sensor 70F and an upper front sensor 70UF that are LIDAR installed on the upper front end of the cabin 10, a left sensor 70L and an upper left sensor 70UL that are LIDAR installed on the upper left end of the upper swivel body 3, and a right sensor 70R and an upper right sensor 70UR that are LIDAR installed on the upper right end of the upper swivel body 3.

The back sensor 70B is configured to detect an object that is present on a diagonally lower back side of the shovel 100. The upper back sensor 70UB is configured to detect an object that is present on a back side and a diagonally upper side of the shovel 100. The front sensor 70F is configured to detect an object that is present on a diagonally lower side and the front side of the shovel 100. The upper front sensor 70UF is configured to detect an object that is present on the diagonally upper side and the front side of the shovel 100. The left sensor 70L is configured to detect an object that is present on the diagonally lower side and the left side of the shovel 100. The upper left sensor 70UL is configured to detect an object that is present on the diagonally upper side and the left side of the shovel 100. The right sensor 70R is configured to detect an object that is present on the diagonally lower side and the right side of the shovel 100. The upper right sensor 70UR is configured to detect an object that is present on the diagonally upper side and the right side of the shovel 100.

The object detection device 70 may be configured to detect a predetermined object within a predetermined region set around the shovel 100. That is, the object detection device 70 may be configured to identify the type of object. For example, the object detection device 70 may be configured to distinguish between a person and an object other than the person. The object detection device 70 may be configured to calculate the distance from the object detection device 70 or the shovel 100 to the recognized object.

In a case where the space recognition device (the object detection device 70) determines, before the actuator activates, that a person is present within a predetermined distance range (predetermined range) from the shovel 100, the controller 30 may disable the actuator or set the actuator to a very slow speed even if it has already output an activation command. The actuator may be, for example, a hydraulic actuator or an electromotive actuator. The hydraulic actuator includes, for example, the boom cylinder 7, the arm cylinder 8, and the bucket cylinder 9.

Specifically, when it is determined that a person is present within a predetermined range, the controller 30 can deactivate the actuator by locking a switch valve (such as a gate lock valve) laid out in the pilot circuit. In the case of an electric operation lever, the controller 30 can deactivate the actuator by disabling the signal from the controller 30 to an operation control valve. If the actuator is caused to have a very slow speed, the controller 30 may reduce the signal from the controller 30 to the operation control valve. Thus, when it is determined that a person is present within a predetermined range, the controller 30 is caused not to drive the actuator or is caused to have a very slow speed even if an action command has already been generated. Furthermore, the controller 30 may stop or decelerate the action of the actuator regardless of an operator's operation if the person is determined to be present within the predetermined range while the operator is operating the operation lever. Specifically, when it is determined that the person is present within the predetermined range, the controller 30 stops the actuator by locking the switch valve (such as a gate lock valve) laid out in the pilot circuit. When the operation control valve is used, the controller 30 can disable the actuator to be inoperable or slow down by disabling the signal to the operation control valve or outputting a deceleration command to the operation control valve. The operation control valve outputs a pilot pressure corresponding to the control command from the controller 30 and causes the pilot port of the corresponding control valve to function in the control valve part 17. Further, when the object detected by the object detection device 70 is a dump truck, the controller 30 does not need to perform a stop control. In this case, the controller 30 may control the movement of the actuator to avoid contact between the sensed dumper truck and the shovel 100. In this manner, the controller 30 can appropriately control the movement of the actuator based on the type of the detected object.

The image capturing device 80 is another example of a circumference monitoring device (space recognition device) for capturing images around the shovel 100. In this embodiment, the image capturing device 80 includes a back camera 80B and an upper back camera 80UB mounted at the back end of the upper surface of the upper swivel body 3, a front camera 80F and an upper front camera 80UF mounted at the front end of the upper surface of the cabin 10, a left camera 80L and an upper left camera 80UL mounted at the left end of the upper surface of the upper swivel body 3, and a right camera 80R and an upper right camera 80UR mounted at the right end of the upper surface of the upper swivel body 3.

The back camera 80B is configured to capture the images of the back side and the diagonally downward side of the shovel 100. The upper back camera 80UB is configured to capture the images of the back side and the diagonally upper side of the shovel 100. The front camera 80F is configured to capture image on the front side and the diagonally lower side of the shovel 100. The upper front camera 80UF is configured to capture the images of the front side and the diagonally upper side of the shovel 100. The left camera 80L is configured to capture the images of the left side and the diagonally lower side of the shovel 100. The upper left camera 80UL is configured to capture the images of the left side and upper diagonally upper side of the shovel 100. The right camera 80R is configured to capture the images of the right diagonally lower side of the shovel 100 diagonally downward. The upper right camera 80UR is configured to capture the images of the shovel 100 at the right side and at the top oblique direction.

Specifically, as illustrated in FIG. 1A, the back camera 80B is configured such that at an angle (a bird's eye angle) φ1 relative to the virtual plane (the virtual horizontal plane in the example of FIG. 1A) where the dashed line M1, which is a virtual line representing the optical axis, is perpendicular to a swivel axis K. The upper back camera 80UB is caused to form an angle (the bird's eye angle) φ2 relative to virtual plane, in which the dashed line M2 that is a virtual line representing the optical axis is perpendicular to the swivel axis K. The front camera 80F is configured such that the angle (the bird's eye angle) φ3 relative to virtual plane that is dashed line M3, which is a virtual line representing the optical axis, forms the angle (the bird's eye angle) φ3 relative to a virtual plane perpendicular to the swivel axis K. The upper front camera 80UF is configured to form an angle (the bird's eye angle) φ4 relative to virtual plane perpendicular to the swivel axis K that is the virtual line (a broken line M4) representing optical axis. Although not illustrated, the left camera 80L and the right camera 80R are similarly configured to form the bird's eye angle relative to the virtual plane where each optical axis is perpendicular to the swivel axis K, and the upper left camera 80UL and the upper right camera 80UR are similarly configured to form the bird's eye angle relative to the virtual plane where each optical axis is perpendicular to the swivel axis K.

In FIG. 1C, the region R1 represents the portion where a monitoring range (an image capturing range) of the front camera 80F and the image capturing range of the upper front camera 80UF overlap, and the region R2 represents the portion where the imaging capturing range of the back camera 80B and the image capturing range of the upper back camera 80UB overlap. That is, the image capturing ranges of the back camera 80B and the upper back camera 80UB are arranged so that the image capturing ranges partially overlap in the vertical directions, and the front camera 80F and upper front camera 80UF are also arranged so that the image capturing ranges partially overlap in the vertical direction. In addition, although not illustrated in the drawings, the left camera 80L and the upper left camera 80UL are also arranged such that image capturing ranges of the left camera 80L and the upper left camera 80UL partially overlap in the vertical direction, and the right camera 80R and the upper right camera 80UR are also arranged such that image capturing ranges of the right camera 80R and the upper right camera 80UR partially overlap in the vertical direction.

As illustrated in FIG. 1C, the back camera 80B is configured so that the dashed line L1, which is a virtual line representing the lower boundary of the image capturing range, forms an angle (the bird's eye angle) θ1 relative to the virtual plane (the virtual horizontal plane in the example of FIG. 1C) perpendicular to the swivel axis K. The upper back camera 80UB is configured so that the dashed line L2, which is a virtual line representing an upper boundary of the image capturing range, forms an angle (the bird's eye angle) θ2 relative to the virtual plane perpendicular to the swivel axis K. The front camera 80F is configured such that the dashed line L3, which is a virtual line representing a boundary under the image capturing range, forms an angle (the bird's eye angle) θ3 relative to the virtual plane perpendicular to the swivel axis K. In the upper front camera 80UF, the dashed line L4, which is a virtual line representing the upper boundary of the image capturing range, is set to have an angle (the bird's eye angle) θ4 relative to the virtual plane perpendicular to the swivel axis K. The angle (the bird's eye angle) θ1 and the angle (the bird's eye angle) θ3, preferably 55 degrees or more. In FIG. 1C, the angle (the bird's eye angle) θ1 is about 70 degrees, and the angle (the bird's eye angle) θ3 is about 65 degrees. The angle (the bird's eye angle) θ2 and the angle (the bird's eye angle) θ4 are preferably 90 degrees or more, more preferably 135 degrees or more, and even more preferably 180 degrees. In FIG. 1C, the angle (the bird's eye angle) θ2 is approximately 115 degrees, and the angle (the bird's eye angle) θ4 is approximately 115 degrees. Although not illustrated, the left camera 80L and the right camera 80R are similarly configured to form an angle of 55 degrees or more relative to the virtual plane in which the lower boundary of each image capturing range is perpendicular to the swivel axis K, and the upper left camera 80UL and the upper right camera 80UR are similarly configured to form an angle of 90 degrees or more relative to the virtual plane in which the upper boundary of each image capturing range is perpendicular to the swivel axis K.

Therefore, the shovel 100 can detect objects that are in an upper space inside the cabin 10 by the upper front camera 80UF. The shovel 100 is also capable of detecting objects that are present in an upper space inside the engine hood by the upper back camera 80UB. The shovel 100 is also capable of detecting the objects that are present in an upper space inside the upper swivel body 3 by the upper left camera 80UL and the upper right camera 80UR. In this manner, the shovel 100 can detect the objects that are present in the upper space inside the shovel 100 by means of the upper back camera 80UB, the upper front camera 80UF, the upper left camera 80UL, and the upper right camera 80UR.

In FIG. 1D, a region R3 represents a portion where the image capturing range of the front camera 80F and the image capturing range of the upper front camera 80UF overlap, a region R4 represents a portion where the image capturing range of the left camera 80L and the image capturing range of the back camera 80B overlap, a region R 5 represents a portion where the image capturing range of the back camera 80B and the image capturing range of the right camera 80R overlap, and a region R6 represents the portion where the image capturing range of the right camera 80R and the image capturing range of the front camera 80F overlap. That is, the front camera 80F and the left camera 80L are arranged such that the image capturing ranges of these two cameras partially overlap in the left and right directions, and the left camera 80L and the back camera 80B are also arranged such that the image capturing ranges of these two cameras partially overlap in the left and right directions. In addition, the back camera 80B and the right camera 80R are arranged such that the image capturing ranges of these two cameras overlap in the left and right directions, and the right camera 80R and the front camera 80F are arranged such that the image capturing ranges of these two cameras overlap in the left and right directions, In addition, although not illustrated, both the upper front camera 80UF and the upper left camera 80UL are arranged such that the image capturing ranges of these two cameras partially overlap in the left and right directions, the upper left camera 80UL and the upper back camera 80UB are also arranged such that the image capturing ranges of these two cameras partially overlap in the left and right directions, and the upper back cameras 80UB and the upper right camera 80UR are also arranged such that the image capturing ranges of these two cameras partially overlap in the left and right directions, and the upper right camera 80UR and the upper front camera 80UF are also arranged such that the image capturing ranges of these two cameras partially overlap in the left and right directions.

Such an arrangement allows the upper front camera 80UF to image objects in the space where the tip of the boom 4 is located and the surrounding space, for example, when the boom 4 is raised to its maximum. Therefore, the controller 30 can prevent the front end of the boom 4 from coming into contact with an electric wire that is present in space over the shovel 100, for example, by using an image captured by the upper front camera 80UF.

The upper front camera 80UF may be installed on the cabin 10 such that the arms 5 and 6 fall within the image capturing range of the upper front camera 80UF, even if at least one from the arm 5 and the bucket 6 is rotated under a boom-upper limit posture, which is a posture in which the boom 4 is raised most. In this case, even if at least one from the arm 5 and the bucket 6 is maximally opened in the boom-upper limit posture, the controller 30 can determine whether surrounding object is likely to come into contact with the excavation attachment AT.

The object detection device 70 may be arranged in the same manner as the image capturing device 80. That is, the back sensor 70B and the upper back sensor 70UB may be arranged so that the monitoring ranges (the detection ranges) of these two cameras partially overlap in the up and down directions, the front sensor 70F and the upper front sensor 70UF may also be arranged so that the monitoring ranges (the detection ranges) of these two cameras partially overlap in the up and down directions, the left sensor 70L and the upper left sensor 70UL may also be arranged so that the monitoring ranges (the detection ranges) of these two cameras partially overlap in the up and down directions, and the right sensor 70R and the upper right sensor 70UR may also be arranged so that the monitoring ranges (the detection ranges) of these two cameras partially overlap in the up and down directions. The front sensor 70F and the left sensor 70L may be arranged so that the detection ranges of these two sensors overlap in the left and right directions, the left sensor 70L and the back sensor 70B may also be arranged such that the detection ranges of these two sensors overlap in the left and right directions, the left sensor 70L and the back sensor 70B may also be arranged such that the detection ranges of these two sensors overlap in the left and right directions, and the right sensor 70R and the front sensor 70F may also be arranged such that the detection ranges of these two sensors overlap in the left and right directions.

The upper front sensor 70UF and the upper left sensor 70UL are arranged so that their detection ranges overlap in the left and right directions, the upper left sensor 70UL and the back sensor 70UB are also arranged so that their detection ranges partially overlap in the left and right directions, the upper back sensor 70UB and the upper right sensor 70UR are also arranged so that their detection ranges partially overlap in the left and right directions, and the upper right sensor 70UR and the upper front sensor 70UF are also arranged so that their detection ranges partially overlap in the left and right directions.

The back sensor 70B, the front sensor 70F, the left sensor 70L, and the right sensor 70R are configured such that each of these optical axes forms a bird's eye angle relative to the virtual plane perpendicular to the swivel axis K, and the upper back sensor 70UB, the upper front sensor 70UF, the upper left sensor 70UL, and the upper right sensor 70UR may be configured such that each of these optical axes forms the bird's eye angle relative to the virtual plane perpendicular to the swivel axis K.

The back sensor 70B, the front sensor 70F, the left sensor 70L, and the right sensor 70R may be configured to form the bird's eye angles relative to the virtual plane where the lower boundary of each of these detection ranges is perpendicular to the swivel axis K, and the upper back sensor 70UB, the upper front sensor 70UF, the upper left sensor 70UL, the upper right sensor 70UR may be configured to form the bird's eye angles relative to the virtual plane where the upper boundary of each of these detection ranges is perpendicular to the swivel axis K.

In this embodiment, the back camera 80B is positioned adjacent the back sensor 70B, the front camera 80F is positioned adjacent the front sensor 70F, the left camera 80L is positioned adjacent the left sensor 70L, and the right camera 80R is positioned adjacent the right sensor 70R, the upper back camera 80UB is positioned adjacent the upper back sensor 70UB, the upper front camera 80UF is positioned adjacent to the upper front sensor 70UF and the upper left camera 80UL is positioned adjacent to the upper left sensor 70UL, and the upper right camera 80UR is positioned adjacent to the upper right sensor 70UR.

In this embodiment, both the object detection device 70 and the image capturing device 80 are installed on the upper swivel body 3 so that they do not protrude from the outer edge of the upper swivel body 3 when viewed in the top view, as illustrated in FIG. 1D. However, at least one from the object detection device 70 and the image capturing device 80 may be installed on the upper swivel body 3 so as to protrude from the outer edge of the upper swivel body 3 with the upper view.

The upper back camera 80UB may be omitted or integrated into the back camera 80B. After the upper back camera 80UB is integrated, the back camera 80B may be configured to cover a wide range of images, including the image capturing range covered by the upper back camera 80UB. The same applies to the upper front camera 80UF, the upper left camera 80UL, and the upper right camera 80UR. In addition, the upper back sensor 70UB may be omitted or integrated into the back sensor 70B. The same applies to the upper front sensor 70UF, the upper left sensor 70UL, and the upper right sensor 70UR. Alternatively, at least two from the upper back camera 80UB, the upper front camera 80UF, the upper left camera 80UL, and the upper right camera 80UR may be integrated as one or more all-hemispherical or hemispherical cameras.

The image captured by the image capturing device 80 is displayed on the display device D1. The image capturing device 80 may be configured such that a viewpoint conversion image, such as the bird's-eye image, can be displayed on the display device D1. For example, the bird's eye image is generated by combining images output by the back camera 80B, the left camera 80L, and the right camera 80R.

The body tilt sensor S4 detects the tilt of the upper swivel body 3 relative to a predetermined plane. In this embodiment, the body tilt sensor S4 is an acceleration sensor for detecting an inclination angle about the front and rear axes and an inclination angle about the right and left axes of the upper swivel body 3 relative to the virtual horizontal plane. The front and back axes and the left and right axes of the upper swivel body 3 are perpendicular each other and pass through a shovel center point, which is a point on the swivel axis of the shovel 100 perpendicular to each other, for example.

The swivel angle speed sensor S5 detects the swivel angular velocity of the upper swivel body 3. In this embodiment, the swivel angle speed sensor S5 is a gyro sensor. The swivel angle speed sensor S5 may be a resolver, a rotary encoder, or the like. The swivel angle sensor S5 may detect a swivel speed. The swivel speed may be calculated from the swivel angle speed.

Hereinafter, the boom angle sensor S1, the arm angle sensor S2, the bucket angle sensor S3, the body tilt sensor S4, and the swivel angle speed sensor S5 are referred to as a posture detecting device.

The display device D1 is a device for displaying information. In this embodiment, the display device D1 is a touch screen having a touch panel as an input device 50 (see FIG. 7). However, the display device D1 may be a display where the input device 50 is separated. In this case, the input device 50 may be a touch pad or a switch panel or the like. A sound output device D2 is a device that outputs sound. Operation device 26 is a device used by an operator for actuator operation. The actuator includes at least one from a hydraulic actuator and an electromotive actuator.

The controller 30 is a controller for controlling the shovel 100. In this embodiment, the controller 30 is made with a computer including a CPU, a volatile storage device, a non-volatile storage device, and the like. The controller 30 reads the program corresponding to each function from the non-volatile storage device and loads the program to the volatile storage device, and performs the corresponding processing to the CPU. Each function includes, for example, the machine guidance function to guide (guide) the manual operation of the shovel 100 by the operator and a machine control function to automatically assist the manual operation of the shovel 100 by an operator.

Figure 2A:
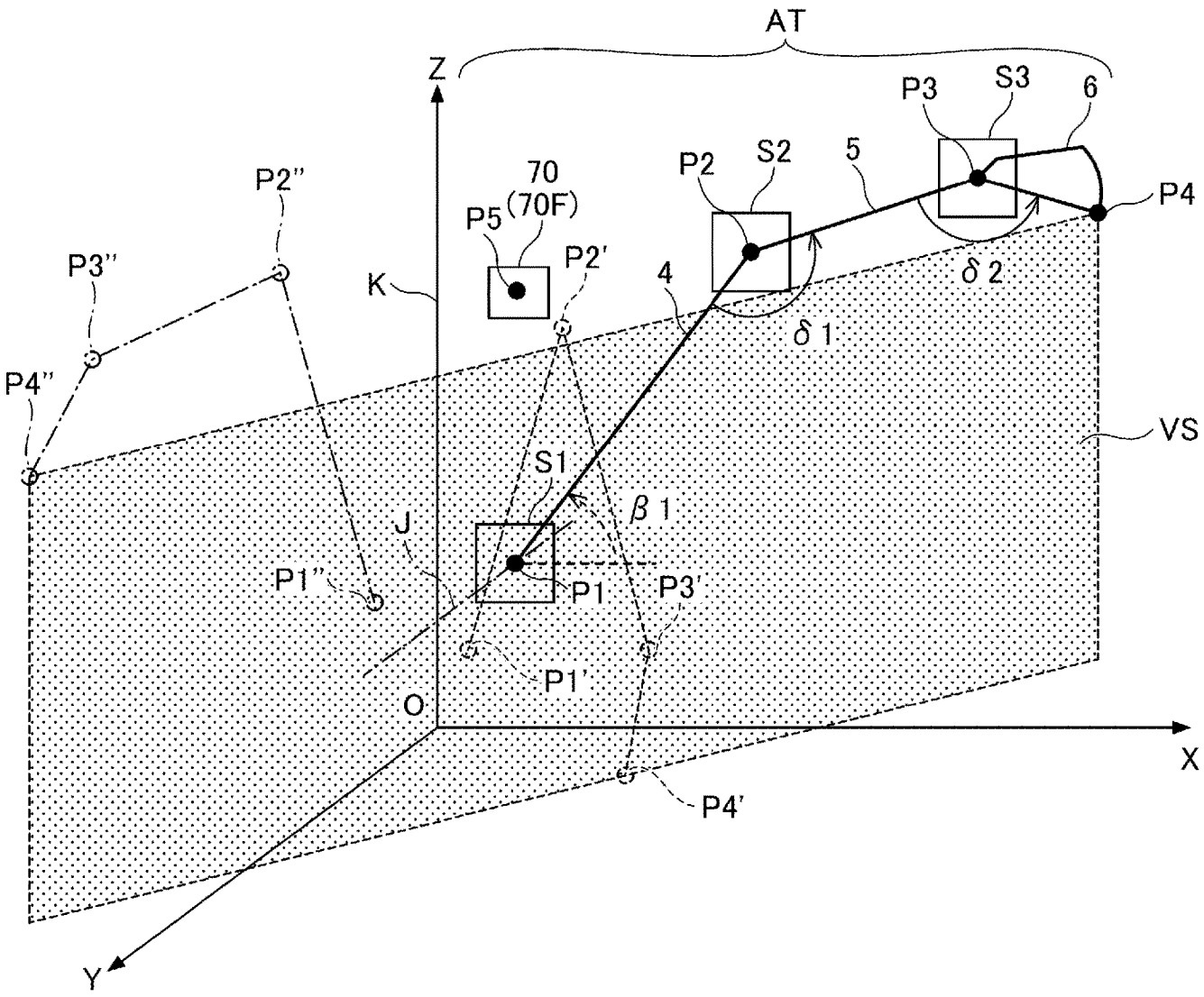
FIG. 2A is a diagram showing a positional relationship of various parts of the shovel.
Figure 2B:
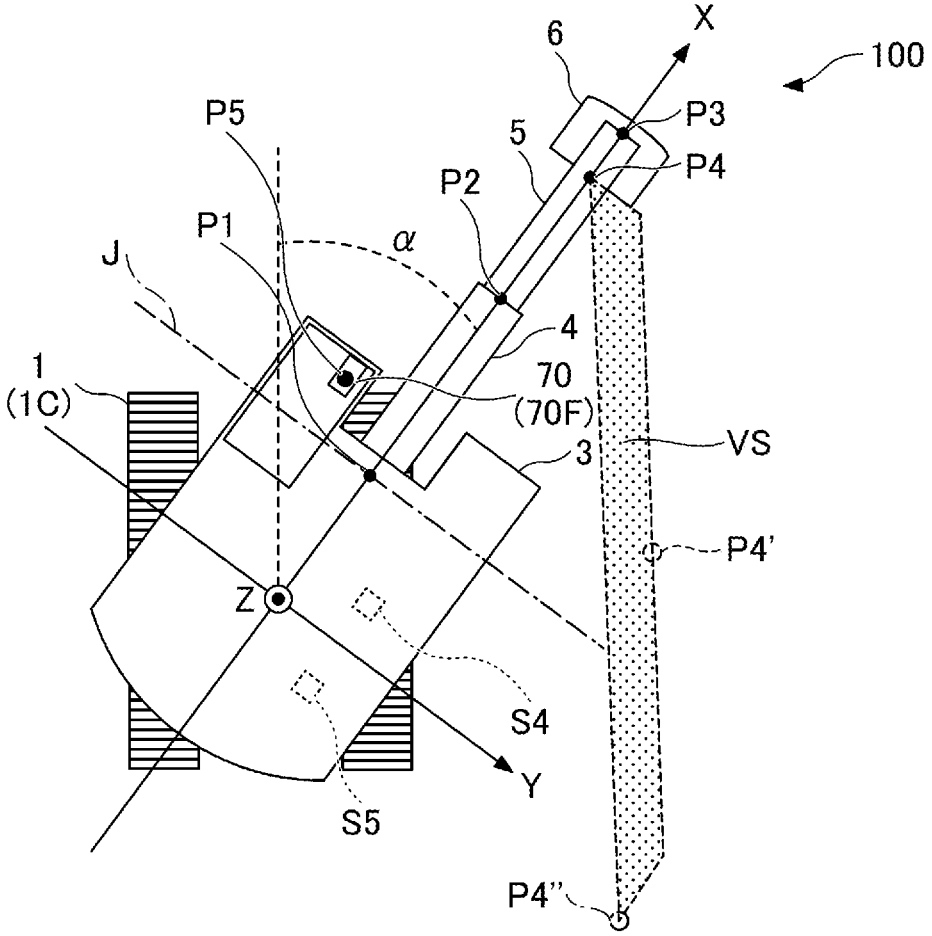
FIG. 2B is a diagram showing the positional relationship of various parts of the shovel.

Referring now to FIGS. 2A and 2B, the function of the controller 30 to recognize the posture of the shovel 100 will be described. FIGS. 2A and 2B are diagrams illustrating the positional relationship of the parts constituting the shovel 100. Specifically, FIG. 2A is a side view of the shovel 100 and FIG. 2B is a top view of the shovel 100. For clarity, in FIG. 2A, the excavation attachment AT is illustrated using a simplified model, in which the components other than the excavation attachment AT are omitted from the main components of the shovel 100.

As illustrated in FIG. 2A, the boom 4 is configured to swing up and down about the swing axis J parallel to the Y-axis relative to the upper swivel body 3. The arm 5 is attached to the front end of the boom 4. The bucket 6 is attached to the front end of the arm 5. The boom angle sensor S1 is attached to a connecting portion between the upper swivel body 3 and the boom 4 at the position indicated by the point P1. The arm angle sensor S2 is attached to a connecting portion between the boom 4 and the arm 5 at the position indicated by the point P2. A bucket angle sensor S3 is attached to a connecting portion between the arm 5 and the bucket 6 at the position indicated by a point P3. A point P4 indicates the position of the tip (claw edge) of bucket 6 and point P5 indicates the position of the front sensor 70F.

The boom angle sensor S1 measures the boom angle β1, which is an angle between the longitudinal direction of the boom 4 and the reference horizontal plane. The reference horizontal plane may be, for example, the ground plane of the shovel 100. The arm angle sensor S2 measures an arm angle β2 that is an angle between the longitudinal direction of the boom 4 and the longitudinal direction of the arm 5. The bucket angle sensor S3 measures the bucket angle β3, which is the angle between the longitudinal direction of the arm 5 and the longitudinal direction of the bucket 6. The longitudinal direction of the boom 4 means the direction of the straight line passing through points P1 and P2 in the reference vertical plane perpendicular to the oscillation axis J (in the XZ plane). The longitudinal direction of arm 5 refers to the direction of the straight line passing through points P2 and P3 in the reference vertical plane. The longitudinal direction of bucket 6 refers to the direction of the straight line passing through points P3 and P4 in the reference vertical plane. The swing axis J is arranged at a position remote from the swivel axis K (Z-axis). However, the swing axis J may be arranged so that the swivel axis K and the swing axis J intersect each other.

As illustrated in FIG. 2B, the upper swivel body 3 is configured to swivel to the right and left relative to the lower travel body 1 about the pivoting axis K that forms the Z-axis. A tilt sensor S4 and a swivel angle speed sensor S5 are attached to the upper swivel body 3.

The body tilt sensor S4 measures the angle between the right and left axes (Y-axis) of the upper swivel body 3 and a reference horizontal plane and the angle between the front and back axes (X-axis) of the upper swivel body 3 and the reference horizontal plane. The swivel angle speed sensor S5 measures the angle α between the longitudinal direction of the lower travel body 1 and the longitudinal axis (X axis) of the upper swivel body 3. The longitudinal direction of the lower travel body 1 means the direction in which the crawler 1C extends.

The controller 30 can obtain a relative position of the point P1 relative to the origin O based on, for example, the outputs of the body tilt sensor S4 and the swivel angle speed sensor S5. This is because the point P1 is fixedly arranged on the upper swivel body 3. The origin O is, for example, the intersection of the reference horizontal plane and the Z-axis. The controller 30 can also obtain the relative positions of the points P2 to P4 relative to the point P1 based on the outputs of the boom angle sensor S1, the arm angle sensor S2, and the bucket angle sensor S3, respectively. Similarly, the controller 30 may derive a relative position of any portion of the excavation attachment AT, such as the end of the back surface of the bucket 6, relative to the point P1.

Points P1' to P4' connected by the dashed lines illustrated in FIG. 2A correspond to the points P1-P4 passing while the upper swivel body 3 passes while is swiveled to the right and the posture of the excavation attachment AT is changed. Similarly, the points P1" to P4" connected by the dashed single-dotted lines in FIG. 2A correspond to the points P1 to P4, at which the upper swivel body 3 is further turned to the right and the posture of the excavation attachment AT is further changed. Namely, the points P1' and P1" indicate the positions of the connections between the upper swivel body 3 and the boom 4, the points P2' and P2" indicate the positions of the connections between the boom 4 and the arm 5, the points P3' and P3" indicate the positions of the connections between the arm 5 and the bucket 6, and the points P4' and P4" indicate the positions of the front end (claw edge) of the bucket 6. Also, the region indicated by the dot pattern in FIG. 2A represents virtual planes VS (described later) defined by the points P4, P4', and P4".

The controller 30 can obtain the relative position of the point P5 relative to the origin O based on the relative position of the point P1 relative to the origin O. This is because the front sensor 70F is secured to the upper surface of the cabin 10. Said differently, the relative positions of the points P1 and P5 do not change even if the action of the excavation attachment AT and the swivel of the upper swivel body 3 are performed.

The controller 30 can also obtain a relative position of the object that is present around the shovel relative to the origin O based on the relative position of the point P5 relative to the origin O. This is because the front sensor 70F is configured to obtain a distance and a direction from the point P5 to each point of the object. Said differently, the relative position of the object relative to the point P5 can be obtained.

In this manner, the controller 30 can obtain the posture of the excavation attachment AT, the predetermined position of the excavation attachment AT (e.g., the claw edge of the bucket 6), and the position of the object that is present around the shovel 100 based on the output of the boom angle sensor S1, the arm angle sensor S2, the bucket angle sensor S3, the body tilt sensor S4, the swivel angle velocity sensor S5, and the object detection device 70.

Figure 3A:
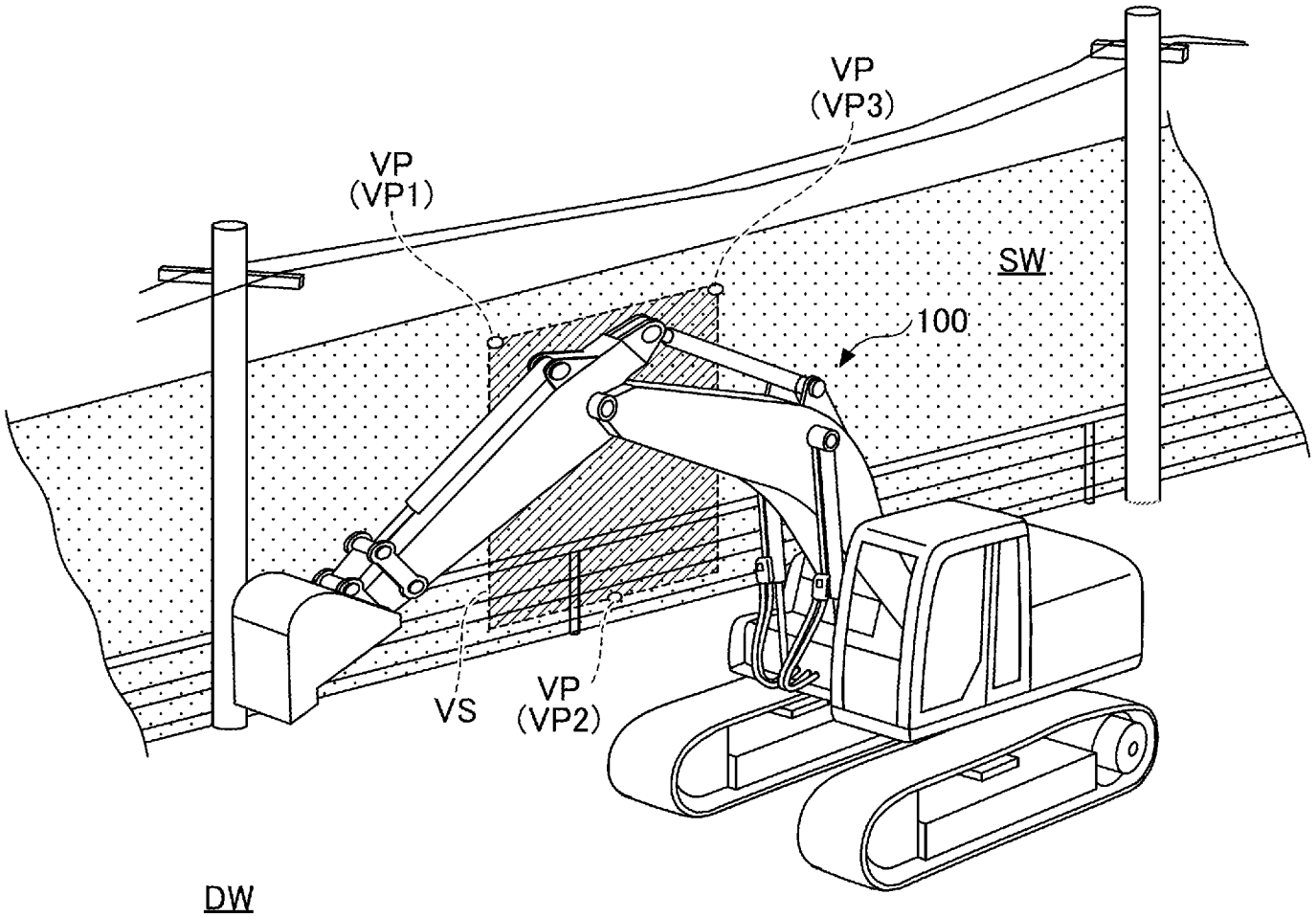
FIG. 3A is a diagrammatic representation of a worksite where an excavation work is to be performed.
Figure 3B:
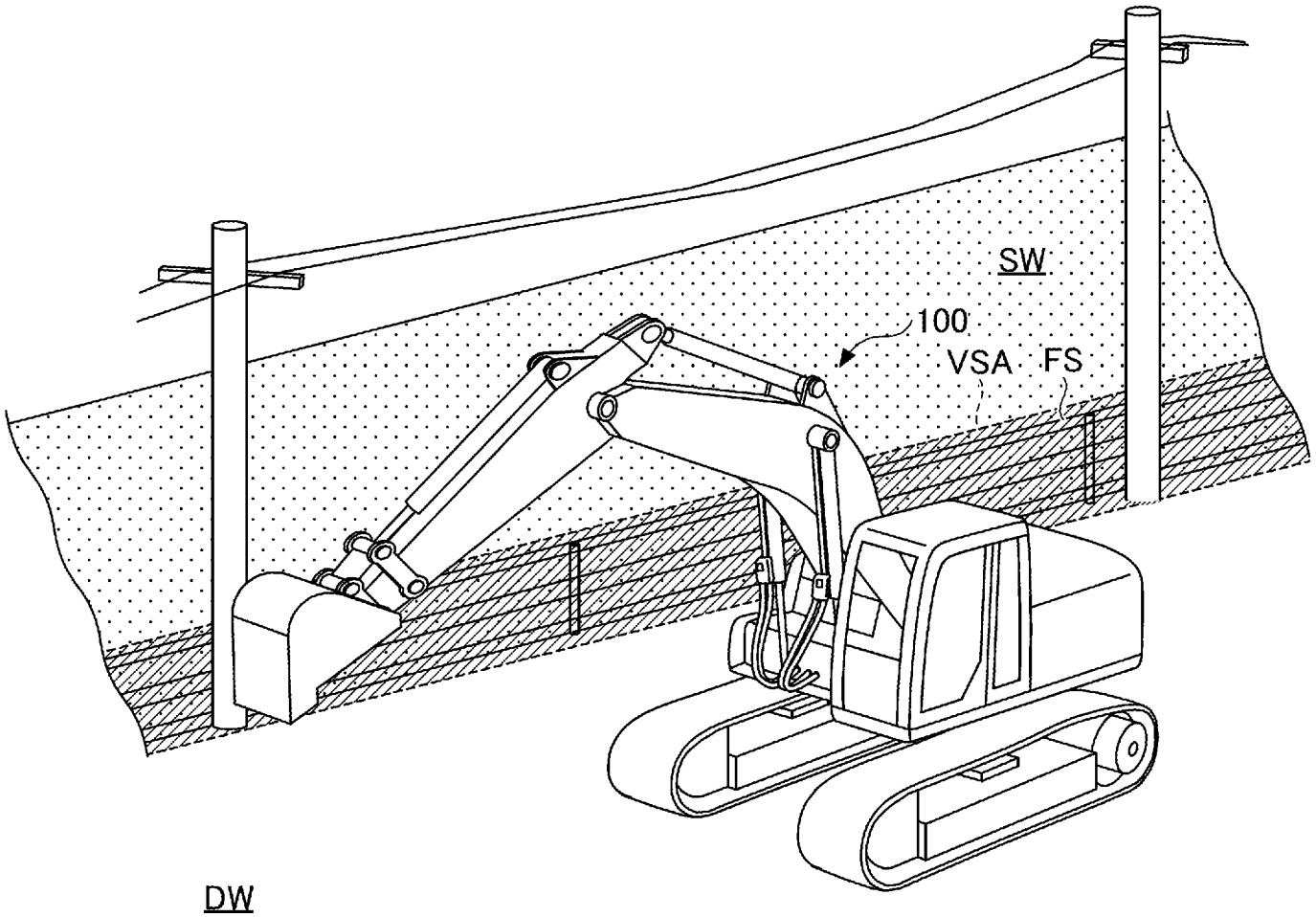
FIG. 3B is a diagrammatic representation of the worksite where the excavation work is to be performed.
Figure 4A:
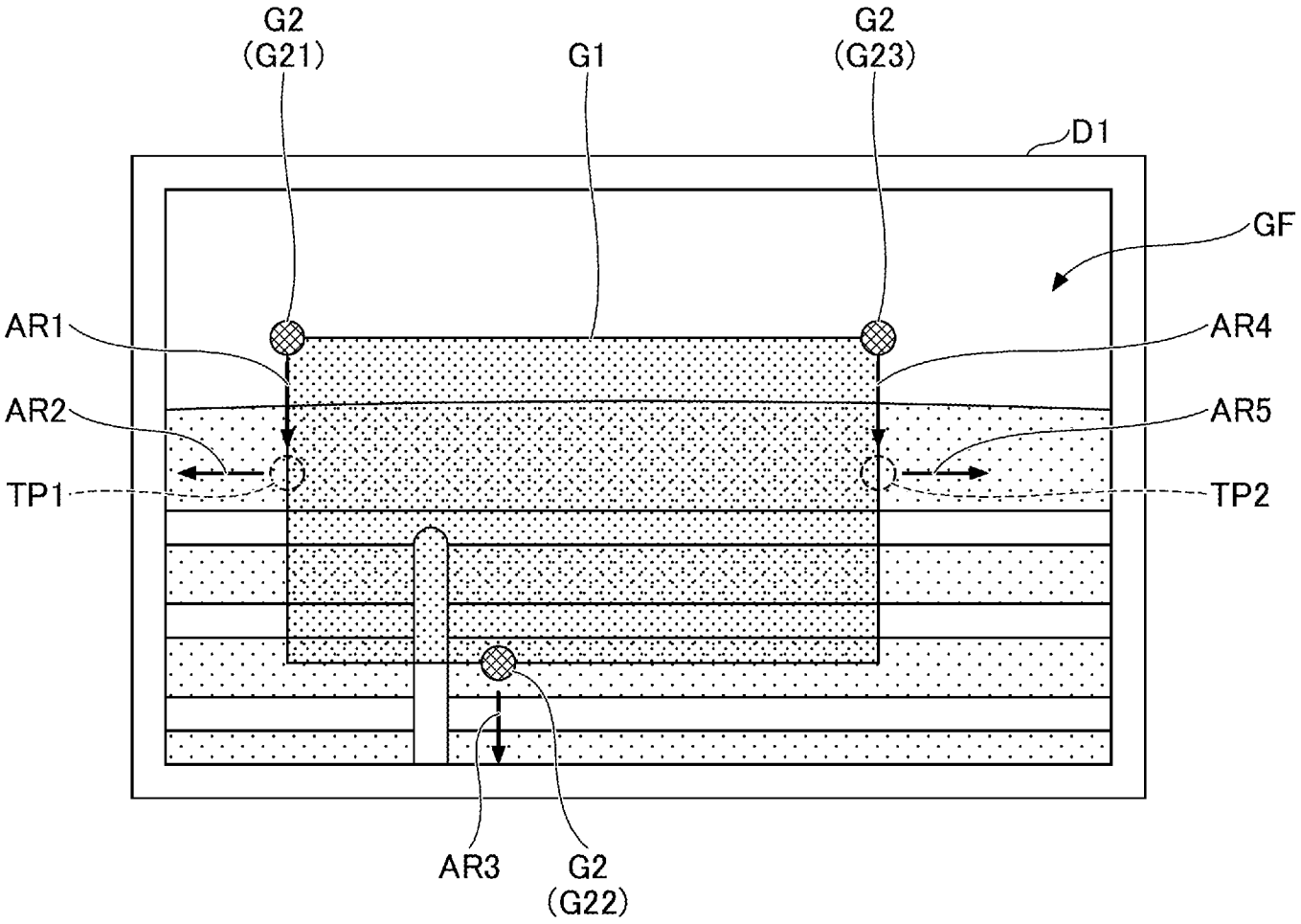
FIG. 4A is an example of an image displayed on a screen of a display device.
Figure 4B:
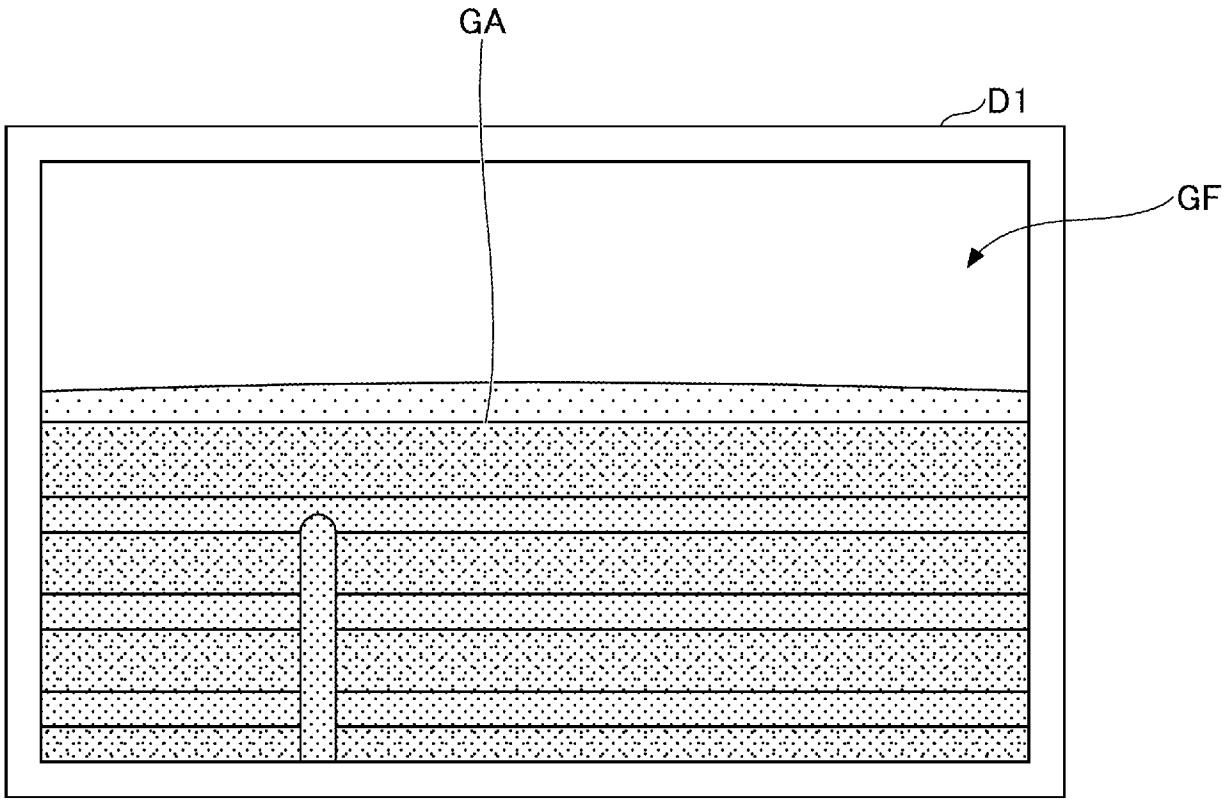
FIG. 4B is an example of the image displayed on the screen of the display device.

Referring now to FIGS. 3A, 3B, 4A, and 4B, an example of a function in which the controller 30 restricts the movement of the shovel 100 (hereinafter, referred to as "function limitation") will be described. FIGS. 3A and 3B are perspective views of the shovel 100 located on a roadway DW. The roadway DW and sidewalk SW are separated by a fence FS. FIGS. 4A and 4B show an example of an image displayed on a screen of display device D1 when setting an approach disabled area. The entry-prohibited region is the area in which the approach of the shovel 100 is prohibited.

The position (coordinates) of the shovel 100 is obtained based on the output of, for example, a positioning device (e.g., a GNSS receiver) installed on the upper swivel body 3. The coordinate is, for example, the coordinate in the reference coordinate system used in a construction plan drawing. The construction plan drawing is a construction plan drawing prepared as an electronic file. The reference coordinate system is, for example, a world geodetic system. The world geodetic system has its origin in the center of gravity of the earth and is the three-dimensional orthogonal XYZ coordinate system having the X-axis in the direction of the intersection of the Greenwich meridian and equator, the Y-axis in the direction of 90 degrees east longitude, and the Z-axis in the direction of the Arctic.

And the controller 30 is for each object detected by the object detection device 70 (for example, each object that is the object to be detected by the object detection device 70). Because the coordinates in the reference coordinate system can be calculated, the positional relationship between each object such as an obstacle and the shovel 100 can be understood. Thus, the controller 30 can also associate the position of each object (each object) with the construction plan drawing. The controller 30 can recognize not only a target construction surface (e.g., ground to be excavated or ground after completion of construction) in the construction plan drawing, but also the position of each object relative to the target construction surface. This allows the controller 30 to display not only the target construction plane but also the position of each object relative to the target construction plane when displaying the construction plan drawings.

The operator of the shovel 100 may define an entry-prohibited region in such a worksite. The operator can define a virtual plane VS, for example, by moving the excavation attachment AT to specify three virtual points VP in a three-dimensional space (real space) at a predetermined portion of the excavation attachment AT (e.g., the claw edge of the bucket 6). In this case, the operator can define the virtual plane VS such that the angle between the virtual horizontal plane and the virtual plane VS is the desired angle. For example, an operator can define a virtual plane VS that crosses the real space obliquely, such as a virtual plane along the slope. Then, the operator can define the entry-prohibited region using one or more virtual planes VS. A predetermined portion of the excavation attachment AT may be, for example, a center portion, right end portion, or left end portion of the claw edge of the bucket 6, or a central portion, right end portion, or left end portion of the back surface of the bucket 6. Also, the three virtual points VP may be specified at a predetermined location of the shovel 100 rather than at a predetermined location of the excavation attachment AT. In this case, the predetermined portion may be a predetermined portion of the upper swivel body 3 (e.g., back end of the counterweight, etc.).

The operator identifies the virtual point VP in real space, for example, by moving the excavation attachment AT and depressing a determination button attached to an end of the operation lever, which is one of the operation devices 26, when the claw edge of the bucket 6 is positioned at a desired position. In the example illustrated in FIG. 3A, the virtual point VP includes a first virtual point VP1, a second virtual point VP2, and a third virtual point VP3.

Specifically, the controller 30 stores the three-dimensional coordinate of the claw edge of the bucket 6 when the determination button is depressed as the three-dimensional coordinate of the first virtual point VP1. The same applies to the second virtual point VP2 and the third virtual point VP3. When the three virtual points VP are stored, the controller 30 obtains a virtual plane VS including the three virtual points VP and displays the virtual plane VS on the screen of the display device D1. The three-dimensional coordinates of the claw edge of the bucket 6 are derived based on the output of the posture detecting device, as illustrated in FIGS. 2A and 2B.

FIG. 3A shows a virtual plane VS in real space when three virtual points VP are specified. The virtual point VP and the virtual plane VS are actually invisible. FIG. 4A illustrates an image G1 of the virtual plane VS displayed on the screen of the display device D1. The image displayed on the screen of the display device D1 includes an image G1 of the virtual plane VS and images G2 of the three virtual points VP, which are superimposed on an image GF captured by the front camera 80F. The image G2 includes an image G21 of the first virtual point VP1, an image G22 of the second virtual point VP2, and an image G23 of the third virtual point VP3.

The operator of the shovel 100 can recognize the position of the virtual plane VS invisible in real space by viewing the image G1 of the virtual plane VS displayed on the screen of the display device D1.

The operator of the shovel 100 may change the information about the virtual plane VS via the input device 50. The information about the virtual plane VS includes location, size, shape, and slope of the virtual plane VS. The tilt is an inclination relative to the virtual horizontal plane or an inclination relative to the virtual vertical plane or the like. The operator can modify information about the virtual plane VS, for example, by a touching operation on the touch panel. For example, the operator may enlarge the size of the virtual plane VS in the real space by enlarging the size of the image G1 by the pinch-out operation, and may reduce the size of the virtual plane VS in the real space by reducing the size of the image G1 by the pinch-in operation. Alternatively, the operator may move the virtual plane VS in parallel in the real space so as to move the image G1 in parallel by swiping or dragging. Alternatively, the operator may make the virtual plane VS to be vertical by tapping or double tapping at a predetermined position on the touch panel in a case where the virtual plane is not vertical but close to vertical. In this case, the virtual plane VS may be made vertical by tapping or double tapping at a predetermined position on the touch panel. Alternatively, if the virtual plane VS is not horizontal but is close to horizontal, the virtual plane VS may be made horizontal by tapping or double tapping at a predetermined position on the touch panel. Alternatively, the operator may implement rotation, tilt, or defamation of the virtual plane VS in the real space by other multi touching operations of performing rotation, tilt, or deformation of the image G1.

Alternatively, the operator may move the image G2 in parallel by a dragging operation of deforming the image G1 and thereby deform the virtual plane VS in real space.

FIG. 3B illustrates a modified virtual plane VSA due to a touching operation. The virtual plane VSA is actually invisible. FIG. 4B illustrates an image GA of the virtual plane VSA displayed on a screen of the display device D1. The image displayed on the screen of the display device D1 includes an image GA of the virtual plane VSA superimposed on the image GF captured by the front camera 80F.

As illustrated in FIG. 4A, the operator of the shovel 100 can lower the upper left corner of the image G1 of the virtual plane VS by touching the image G21 of the first virtual point VP1 and moving the image G21 to the point TP1 by performing the dragging operation in the direction indicated by the arrow AR1. The operator can move the left end of the image G1 to the left by performing a flicking operation in the direction indicated by the arrow AR2. In this embodiment, the left end of the image G1 of the virtual plane VS is moved left infinitely far by the flicking operation.

Further, as illustrated in FIG. 4A, the operator of the shovel 100 can move the lower end of the image G1 downward by performing the flicking operation in the direction represented by the arrow AR3 after touching the image G22 of the second virtual point VP2. In this embodiment, the lower end of the image G1 of the virtual plane VS is moved downward infinitely far by the flicking operation.

Further, as illustrated in FIG. 4A, the operator of the shovel 100 moves the image G23 to the point TP2 by the dragging operation in the direction indicated by the arrow AR4 after touching the image G23 of the third virtual point VP3. Then, the operator can move the right end of the image G1 to a right side by performing a flicking operation in the direction indicated by an arrow AR5. Then, the upper right corner of the image G1 of the virtual plane VS can be lowered. In this embodiment, the right end of the image G1 of the virtual plane VS is moved to the right infinity by the flicking operation.

With the touching operation described above, the operator of the shovel 100 can change the virtual plane VS illustrated in FIG. 3A to the virtual plane VSA illustrated in FIG. 3B. The virtual plane VSA defines the entry-prohibited region to prevent the shovel 100 from contacting a fence FS from the side of the roadway DW.

This entry-prohibited region corresponds to the space occupied by the fence FS. Because this entry-prohibited region has a height approximately equal to the height of the fence FS, the operator of the shovel 100 can move the bucket 6 toward the sidewalk SW beyond, for example, the fence FS.

The virtual plane VSA may be adjusted by the touching operation so as to have a thickness corresponding to the thickness of the fence FS. In this case, thus defined virtual plane VSA can prevent the bucket 6 from approaching and contacting the fence FS from the side of the sidewalk SW.

In the example illustrated in FIG. 3B, the virtual plane VSA modified by the touching operation is generated as the virtual plane extending indefinitely along the extending direction of the fence FS, but may be generated as the virtual plane having a finite length. The size of the virtual plane VSA is changed to be larger than that of the virtual plane VS, but the size may be changed to be smaller than that of the virtual plane VS.

Further, in the example illustrated in FIG. 3B, the operator of the shovel 100 does not set the entry-prohibited region for poles and wires connected between the poles, but similarly to the approach prohibited area for the fence FS, the entry-prohibited region can be set for each pole and wire.

The controller 30 configured to control the movement of the actuator so as to prevent the shovel 100 from crossing the virtual plane VSA. Specifically, the controller 30 is configured to recognize the surrounding environment as if an actual barrier existed at the location of the virtual plane VSA and to control the movement of the shovel 100 such that the shovel 100 does not contact the (non-existent) barrier. In this regard, the virtual plane VSA may function as a virtual barrier to prevent contact between an object that is present beyond the virtual plane VSA and the shovel 100.

The controller 30 may, for example, slow down or stop the swivel action of the upper swivel body 3 when the distance between the virtual plane VSA and a part of the body (e.g., a counterweight) falls below a predetermined value during the swivel action. Alternatively, the controller 30 may slow down or stop a boom lowering operation, for example, when the distance between the virtual plane VSA and the part of the body (e.g., the front end of the boom 4) falls below a predetermined value during the boom lowering operation. The controller 30 may also output an alarm when the distance between the virtual plane VSA and the part of the body falls below a predetermined value. The alarm may be visual or auditory.

With this arrangement, the controller 30 prevents the part of the body from entering the entry-prohibited region during the operation of the shovel 100.

Figure 5:
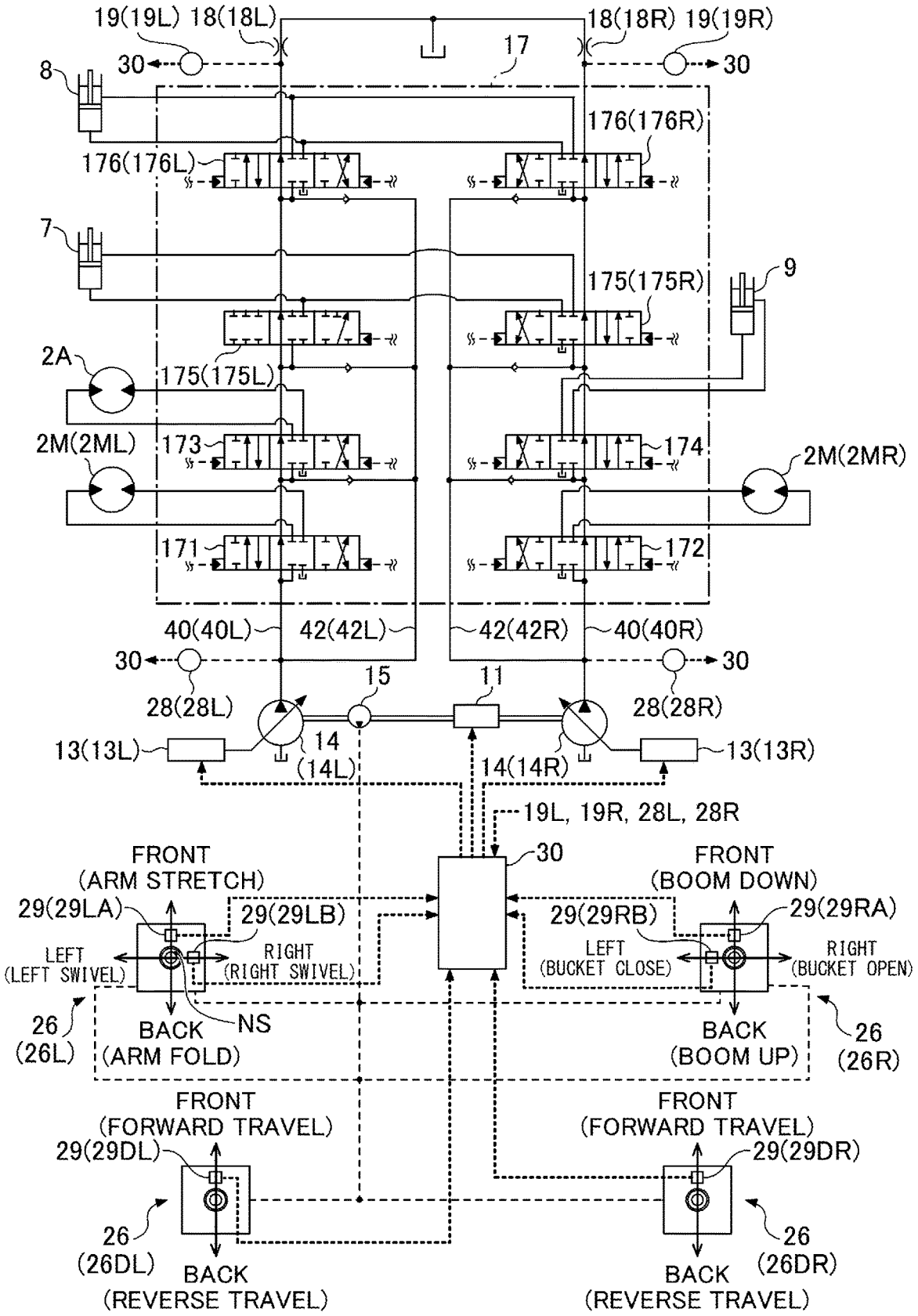
FIG. 5 is a diagram illustrating an example of a configuration of a hydraulic system installed on the shovel.

Next, a configuration example of the hydraulic system installed on the shovel 100 will be described with reference to FIG. 5. FIG. 5 is a diagram illustrating an example of the configuration of the hydraulic system installed on the shovel 100. FIG. 5 illustrates the mechanical power transmission system, hydraulic oil line, pilot line, and electrical control system respectively using double, solid, dashed, and dotted lines.

The hydraulic system of FIG. 5 primarily includes the engine 11, the regulator 13, the main pump 14, the pilot pump 15, the control valve part 17, the operation device 26, the discharge pressure sensor 28, the operation pressure sensor 29, the controller 30, and the like.

In FIG. 5, the hydraulic system causes the hydraulic oil to be circulated from the main pump 14 driven by the engine 11 via the center bypass pipe route 40 or the parallel pipe route 42 to the oil tank.

The engine 11 is a driving source of the shovel 100. In this embodiment, the engine 11 is, for example, a diesel engine that activates so as to maintain a predetermined speed. The output shaft of the engine 11 is coupled to the input shafts of the main pump 14 and the pilot pump 15.

The main pump 14 supplies the hydraulic oil through the hydraulic oil line to the control valve part 17. In this embodiment, the main pump 14 is a swash plate variable displacement hydraulic pump.

The regulator 13 controls the discharge amount of the main pump 14. In this embodiment, the regulator 13 controls the discharge amount of the main pump 14 by adjusting the swash plate tilt angle of the main pump 14 in response to a control command from the controller 30.

The pilot pump 15 is configured to supply the hydraulic oil to a hydraulic control device including the operation device 26 via a pilot line. In this embodiment, the pilot pump 15 is a fixed capacitive hydraulic pump. However, the pilot pump 15 may be omitted. In this case, the function performed by the pilot pump 15 may be implemented by the main pump 14. That is, the main pump 14 may be provided with a function of supplying the hydraulic oil to the control valve part 17, as well as a function of supplying hydraulic oil to the operation device 26 after the pressure of the hydraulic oil is lowered by a choke or the like.

The control valve part 17 is a hydraulic controller which controls the hydraulic system of the shovel 100. In this embodiment, the control valve part 17 includes the control valves 171 to 176. The control valve part 175 includes the control valve 175L and a control valve 175R, and the control valve part 176 includes a control valve 176L and a control valve 176R. The control valve part 17 may selectively supply the hydraulic oil discharged by the main pump 14 to one or more hydraulic actuators through the control valves 171 to 176. The control valves 171 to 176 control the flow rate of hydraulic oil flowing from the main pump 14 to the hydraulic actuator and are they hydraulic actuators, the flow rate of the hydraulic oil flowing into the flow rate of the hydraulic oil flowing into the spiral oil tank oil tank. The hydraulic actuator includes the boom cylinder 7, the arm cylinder 8, the bucket cylinder 9, the left travel hydraulic motor 2ML, the right travel hydraulic motor 2MR, and the swivel hydraulic motor 2A.

The operation device 26 is a device used by the operator to perform the actuator operation. The actuator includes at least one from a hydraulic actuator and an electromotive actuator. In this embodiment, the operation device 26 supplies the hydraulic oil discharged by the pilot pump 15 via a pilot line to a pilot port of a corresponding control valve in the control valve part 17. The pressure (pilot pressure) of the hydraulic oil supplied to each of the pilot ports is the pressure corresponding to the direction and operation amount of the operation device 26 corresponding to each of the hydraulic actuators. However, the operation device 26 may be electrically controlled rather than a pilot pressure system as described above. In this case, the control valve in the control valve part 17 may be a solenoid spool valve.

The discharge pressure sensor 28 detects the discharge pressure of the main pump 14. In this embodiment, the discharge pressure sensor 28 outputs the detected value to the controller 30.

The operation pressure sensor 29 detects the contents of the operation of the operation device 26 by the operator. In this embodiment, the operation pressure sensor 29 detects pressures (operation pressures) representing the operation directions and operation amounts of levers or pedals of the operation device 26 corresponding to the actuators, and outputs the detected values to the controller 30. The contents of the operation of the operation device 26 may be detected using sensors other than the operation pressure sensor.

The main pump 14 includes a left main pump 14L and a right main pump 14R. The left main pump 14L circulates the hydraulic oil through the left center bypass pipe route 40L or the left parallel pipe route 42L to the hydraulic oil tank, and the right main pump 14R circulates the hydraulic oil through the right center bypass pipe route 40R or the right parallel pipe route 42R to the hydraulic oil tank.

The left center bypass pipe route 40L is a hydraulic oil line through the control valves 171, 173, 175L and 176L disposed within the control valve part 17. The right center bypass pipe route 40R is a hydraulic oil line through the control valves 172, 174, 175R and 176R disposed inside the control valve part 17.

The control valve part 171 is a spool valve which feeds the hydraulic oil discharged by the left main pump 14L to the left travel hydraulic motor 2ML and switches the flow of hydraulic oil in order to discharge the hydraulic oil discharged by the left travel hydraulic motor 2ML to a working oil tank.

The control valve part 172 is a spool valve that supplies the hydraulic oil discharged by the right main pump 14R to the right driving hydraulic motor 2MR and switches the flow of hydraulic oil in order to discharge the hydraulic oil discharged by the right driving hydraulic motor 2MR to the working oil tank.

The control valve part 173 is a spool valve which feeds the hydraulic oil discharged by the left main pump 14L to the swivel hydraulic motor 2A and switches the flow of hydraulic oil in order to discharge the hydraulic oil discharged by the swivel hydraulic motor 2A to the working oil tank.

The control valve part 174 is a spool valve which feeds the hydraulic oil discharged by the right main pump 14R to the bucket cylinder 9 and switches the flow of hydraulic oil in order to discharge the hydraulic oil in the bucket cylinder 9 to the working oil tank.

The control valve part 175L is a spool valve which switches the flow of hydraulic oil in order to supply the hydraulic oil discharged by the left main pump 14L to the boom cylinder 7. The control valve part 175R is a spool valve which feeds the hydraulic oil discharged by the right main pump 14R to the boom cylinder 7 and switches the flow of hydraulic oil in order to discharge the hydraulic oil in the boom cylinder 7 to the working oil tank.

The control valve part 176L is a spool valve which feeds the hydraulic oil discharged by the left main pump 14L to the arm cylinder 8 and switches the flow of hydraulic oil in order to discharge the hydraulic oil in the arm cylinder 8 to the hydraulic oil tank.

The control valve part 176R is a spool valve for feeding the hydraulic oil discharged by the right main pump 14R to the arm cylinder 8 and switching the flow of hydraulic oil to drain the hydraulic oil in the arm cylinder 8 to the hydraulic oil tank.

The left parallel pipe route 42L is a hydraulic oil line parallel to the left center bypass pipe route 40L. The left parallel pipe route 42L can supply the hydraulic oil to a downstream control valve when the flow of hydraulic oil through the left center bypass pipe route 40L is restricted or interrupted by either of the control valves 171, 173, and 175L. The right parallel pipe route 42R is a hydraulic oil line parallel to the right center bypass pipe route 40R. The right parallel pipe route 42R can supply the hydraulic oil to the lower control valves when the flow of hydraulic oil through the right center bypass pipe route 40R is restricted or interrupted by either of the control valves 172, 174, and 175R.

The regulator 13 includes a left regulator 13L and a right regulator 13R. The left regulator 13L controls the discharge amount of the left main pump 14L by adjusting the swash plate inclination angle of the left main pump 14L in response to the discharge pressure of the left main pump 14L. Specifically, for example, the left regulator 13L decreases the discharge amount in response to an increase in the discharge pressure of the left main pump 14L by adjusting the swash plate inclination angle of the left main pump 14L. The same applies to the right regulator 13R. At this time, the horsepower absorbed by the main pump 14, which is expressed as the product of the discharge pressure and the discharge amount, does not exceed the output horsepower of the engine 11.

The operation device 26 includes a left operation lever 26L, a right operation lever 26R and a travel lever 26D. The travel lever 26D includes a left travel lever 26DL and a right travel lever 26DR.

The left operation lever 26L is used for the swivel operation and the operation of the arm 5. The left operation lever 26L, when operated in the front and back directions, utilizes the hydraulic oil discharged by the pilot pump 15 to introduce a control pressure in response to the lever operation amount into the pilot port of the control valve part 176. When operated in the right and left directions, the hydraulic oil discharged by the pilot pump 15 is used to introduce the control pressure in response to the lever operation amount into the pilot port of the control valve part 173.

Specifically, when the left operation lever 26L is operated in the arm closing direction, the right pilot port of the control valve part 176L is introduced with the hydraulic oil and the left pilot port of the control valve part 176R is introduced with the hydraulic oil. The left operation lever 26L, when operated in the arm opening direction, introduces hydraulic oil to the left pilot port of the control valve part 176L and introduces hydraulic oil to the right pilot port of the control valve part 176R. The left operation lever 26L introduces hydraulic oil to the left pilot port of the control valve part 173 when it is operated in the left turn direction and introduces hydraulic oil to the right pilot port of the control valve part 173 when it is operated in the right swivel direction.

The right operation lever 26R is used to operate the boom 4 and the bucket 6. The right operation lever 26R utilizes hydraulic oil discharged by the pilot pump 15 when operated in the front and back directions to introduce the control pressure according to the lever operation amount into the pilot port of the control valve part 175. When operated in the right and left directions, the hydraulic oil discharged by the pilot pump 15 is used to introduce the control pressure in response to the lever operation amount into the pilot port of the control valve part 174.

Specifically, when the right operation lever 26R is operated in the boom lowering direction Introduce hydraulic oil into the left pilot port of the control valve part 175R. The right operation lever 26R, when operated in the boom raising direction, introduces hydraulic oil to the right pilot port of the control valve part 175L and introduces hydraulic oil to the left pilot port of the control valve part 175R. The right operation lever 26R introduces the hydraulic oil to the right pilot port of the control valve part 174 when it is operated in the bucket closing direction, and introduces the hydraulic oil to the left pilot port of the control valve part 174 when it is operated in the bucket opening direction.

The travel lever 26D is used to operate the crawler 1C. Specifically, the left travel lever 26DL is used to operate the left crawler 1CL. It may be configured to interlock with the left travel pedal. The left travel lever 26DL, when operated in the forward and backward direction, utilizes hydraulic oil discharged by the pilot pump 15 to introduce a control pressure according to the lever operating amount into the pilot port of the control valve part 171. The right travel lever 26DR is used to operate the right crawler 1CR. It may be configured to interlock with a right travel pedal. The right travel lever 26DR utilizes the hydraulic oil discharged by the pilot pump 15 when operated in the front and back directions. A control pressure in response to the lever operation amount is introduced to the pilot port of the control valve part 172.

The discharge pressure sensor 28 includes the discharge pressure sensor 28L and the discharge pressure sensor 28R. The discharge pressure sensor 28L detects the discharge pressure of the left main pump 14L and outputs a detected value to the controller 30. The same applies to the discharge pressure sensor 28R.

The operation pressure sensor 29 includes operation pressure sensors 29LA, 29LB, 29RA, 29 RB, 29DL, and 29DR. The operation pressure sensor 29LA detects the contents of the front and back operations by the operator relative to the left operation lever 26L in the form of pressure and outputs the detected value to the controller 30. The contents of the operations are the lever operation direction and the lever operation amount (a lever operation angle), for example.

Similarly, the operation pressure sensor 29LB detects the contents of the operator's left-to-right operation relative to the left operation lever 26L in the form of pressure and outputs the detected value to the controller 30. The operation pressure sensor 29RA detects the contents of the operator's forward and backward operation to the right operation lever 26R in the form of pressure and outputs the detected value to the controller 30. The operation pressure sensor 29RB detects the contents of the operation by the operator in the left and right directions relative to the right operation lever 26R in the form of pressure and outputs the detected value to the controller 30. The operation pressure sensor 20DL detects the contents of the operation in the forward and backward direction relative to the left travel lever 26DL by the operator in the form of pressure and outputs the detected value to the controller 30. The operation pressure sensor 29DR detects the contents of the operation in the forward and backward direction relative to the right travel lever 26DR by the operator in the form of pressure and outputs the detected value to the controller 30.

The controller 30 receives the output of the operation pressure sensor 29 and outputs a control command to the regulator 13 as needed to change the discharge amount of the main pump 14. The controller 30 is also provided with a control pressure sensor 19 upstream of a choke 18. The output of the control pressure sensor 19 is received, and a control command is output to the regulator 13 as needed to change the discharge amount of the main pump 14. The choke 18 includes a left choke 18L and a right choke 18R, and the control pressure sensor 19 includes a left control pressure sensor 19L and a right control pressure sensor 19R.

In the left center bypass pipe route 40L, a left throttle 18L is disposed between the control valve part 176L, which is the lowest, and the hydraulic oil tank. Therefore, the flow of hydraulic oil discharged by the left main pump 14L is limited by the left choke 18L. In addition, the left choke 18L produces a control pressure for controlling the left regulator 13L. The left control pressure sensor 19L is a sensor for detecting this control pressure. The detected value is output to the controller 30. The controller 30 controls the discharge amount of the left main pump 14L by adjusting the tilting angle of the swash plate of the left main pump 14L in response to the control pressure. The controller 30 decreases the discharge amount of the left main pump 14L as the control pressure increases and increases the discharge amount of the left main pump 14L as the control pressure decreases. The discharge amount of the right main pump 14R is similarly controlled.

Specifically, when none of the hydraulic actuators at the shovel 100 is in the standby state as illustrated in FIG. 5, the hydraulic oil discharged by the left main pump 14L passes through the left center bypass pipe route 40L until the left squeeze reaches 18L. The flow of the hydraulic oil discharged by the left main pump 14L causes the control pressure that is generated on the upstream side of the left choke 18L to increase. As a result, the controller 30 restricts the discharge amount of the left main pump 14L to a permissible minimum discharge amount and a pressure loss (a pumping loss) occurring when the discharged hydraulic oil passes through the left center bypass pipe route 40L. On the other hand, when any one of the hydraulic actuators is operated, the hydraulic oil discharged by the left main pump 14L flows into the hydraulic actuator as an operation target through a control valve corresponding to the hydraulic actuator as the operation target. The hydraulic oil discharged by the left main pump 14L flows into the hydraulic actuator as the operation target through a control valve corresponding to the hydraulic actuator as the operation target. The flow of the hydraulic oil discharged by the left main pump 14L decreases or disappears the amount reaching the left choke 18L, thereby lowering the control pressure generated in the upstream of the left choke 18. As a result, the controller 30 increases the discharge amount of the left main pump 14L and sufficient hydraulic oil is circulated to the hydraulic actuator as the operation target to ensure the driving of the hydraulic actuator as the operation target. The controller 30 controls the discharge amount of the right main pump 14R in the same manner.

With the configuration described above, the hydraulic system illustrated in FIG. 5 can reduce wasted energy consumption at the main pump 14 in standby conditions. The wasteful energy consumption includes the pumping loss caused by the hydraulic oil discharged by the main pump 14 in the center bypass pipe route 40. The hydraulic system of FIG. 5 also ensures that sufficient hydraulic fluid is supplied from the main pump 14 to the hydraulic actuator to be actuated when the hydraulic actuator is operated.

Figure 6A:
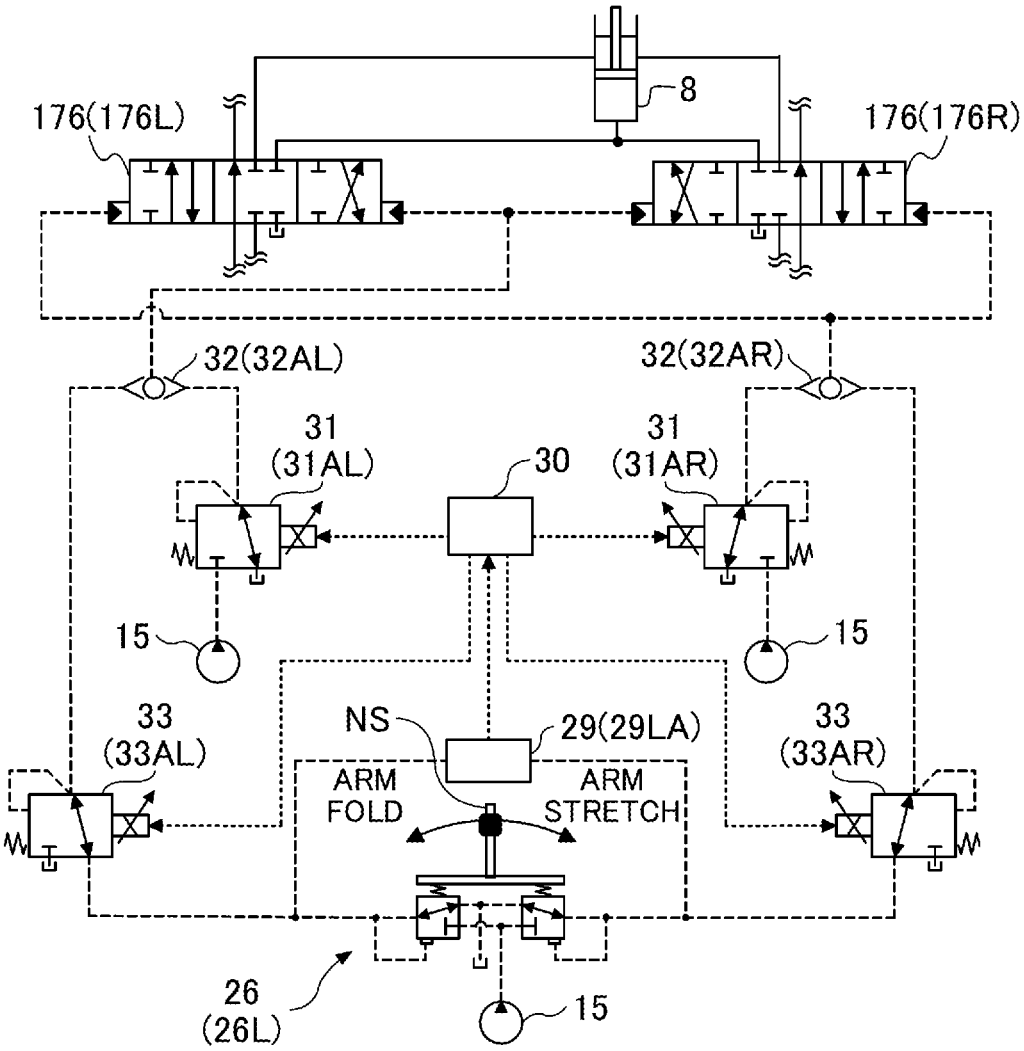
FIG. 6A is a drawing of a portion of the hydraulic system illustrated in FIG. 5.
Figure 6B:
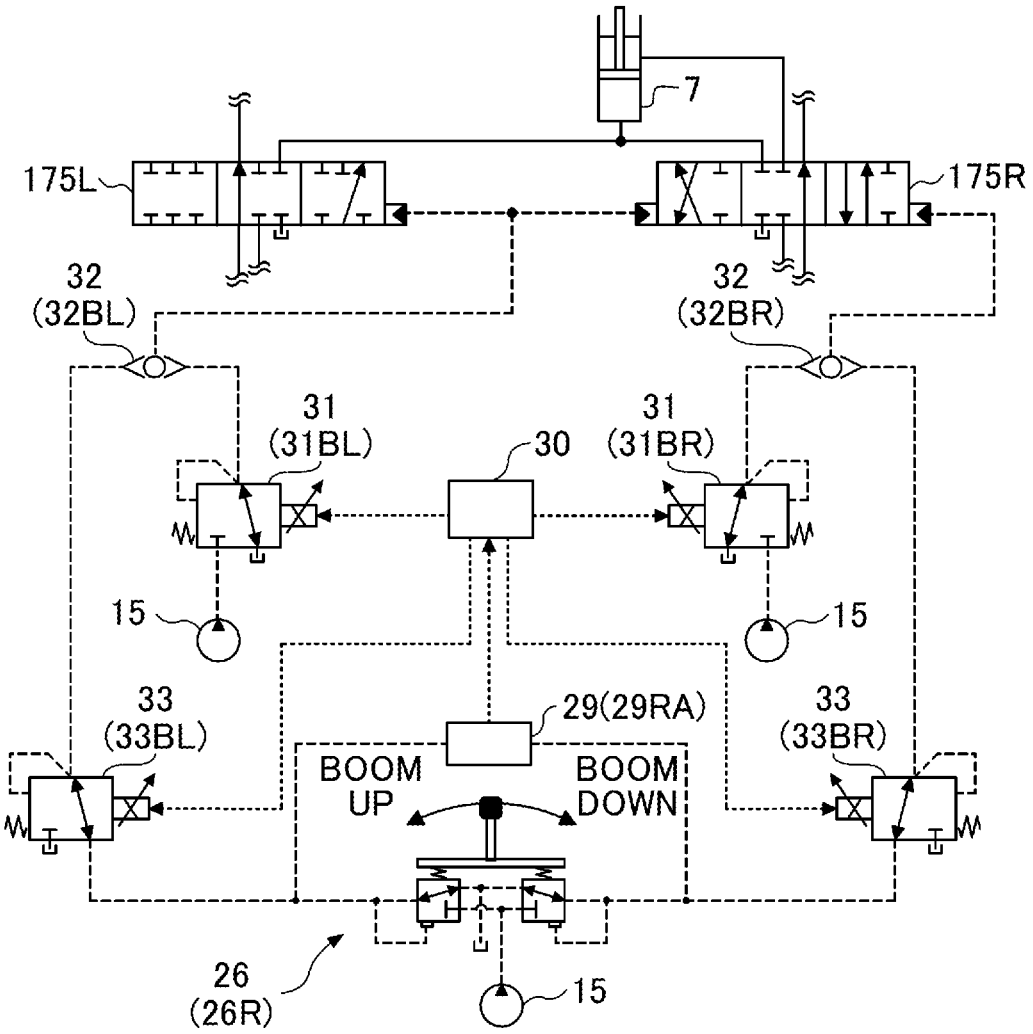
FIG. 6B is a drawing of a portion of the hydraulic system illustrated in FIG. 5.
Figure 6C:
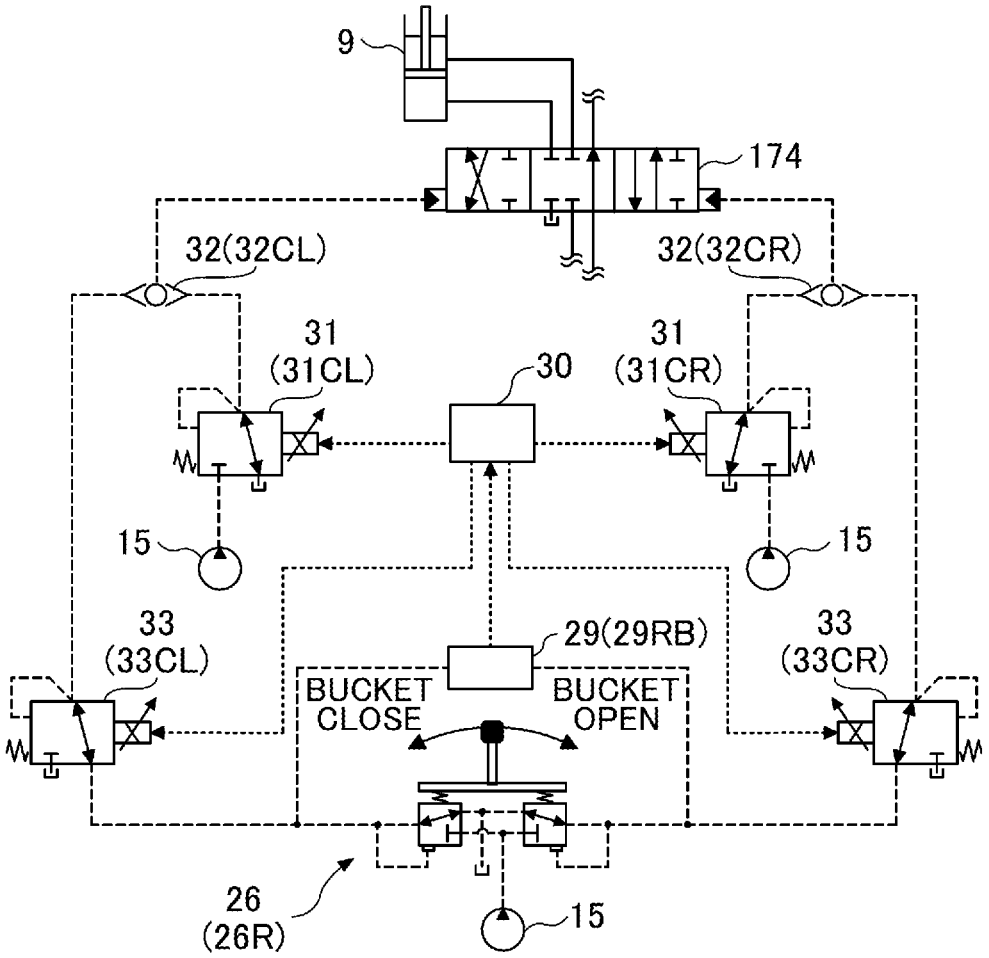
FIG. 6C is a drawing of a portion of the hydraulic system illustrated in FIG. 5.
Figure 6D:
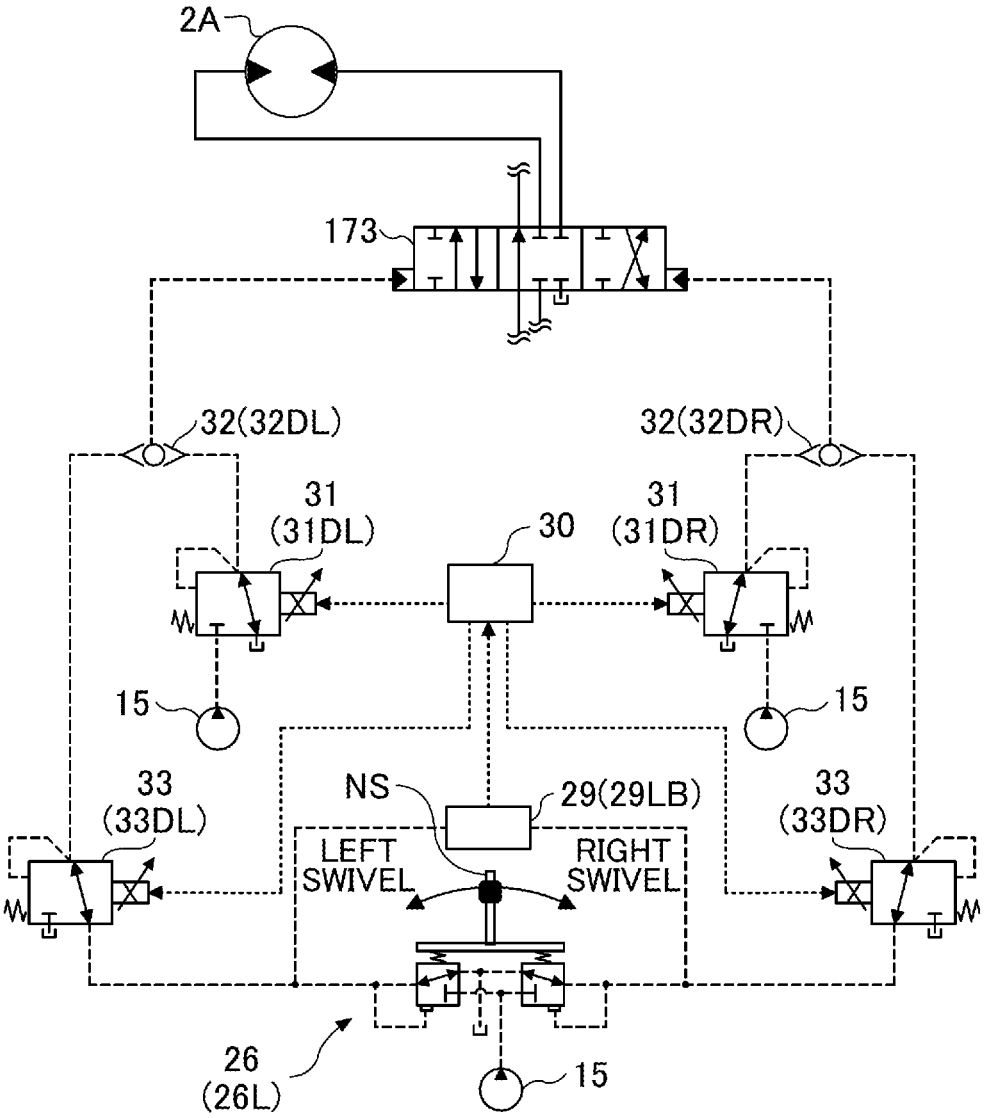
FIG. 6D is a drawing of a portion of the hydraulic system illustrated in FIG. 5.

Referring now to FIGS. 6A to 6D, a configuration will be described for the controller 30 to automatically operate the actuator by a machine control function. FIGS. 6A to 6D illustrate a portion drawn out of the hydraulic system. Specifically, FIG. 6A illustrates a hydraulic system part relating to the operation of the arm cylinder 8, and FIG. 6B illustrates the hydraulic system part relating to the operation of the swivel hydraulic motor 2A. FIG. 6C illustrates the hydraulic system part relating to the operation of the boom cylinder 7, and FIG. 6D illustrates the hydraulic system part relating to the operation of the bucket cylinder 9.

As illustrated in FIGS. 6A to 6D, the hydraulic system includes the proportional valve 31, the shuttle valve 32, and the proportional valve 33. The proportional valve 31 includes proportional valves 31AL-31DL and 31AR-31DR, the shuttle valve 32 includes shuttle valves 32AL-32DL and 32AR-32DR, and the proportional valve 33 includes proportional valves 33AL-33DL and 33AR-33DR.

The proportional valve 31 functions as a control valve for machine control. The proportional valve 31 is disposed in a pipe route connecting the pilot pump 15 and the shuttle valve 32 and is configured to change the flow line area of the pipe route. In this embodiment, the proportional valve 31 operates in response to a control command output by the controller 30. Therefore, the controller 30 discharges the hydraulic oil from the pilot pump 15 and supplies the discharged hydraulic oil, via the proportional valve 31 and the shuttle valve 32, to a pilot port of a corresponding control valve in control valve part 17, regardless of the operator's operation of the operation device 26.

The shuttle valve 32 has two inlet ports and one outlet port. One of the two inlet ports is connected to the operation device 26 and the other is connected to the proportional valve 31. The outlet port is connected to a pilot port of a corresponding control valve in the control valve part 17. Therefore, the shuttle valve 32 can cause the higher of the pilot pressure generated by the operation device 26 and the pilot pressure generated by the proportional valve 31 to act on the corresponding pilot port of the control valve.

The proportional valve 33 functions as a machine control valve as well as the proportional valve 31. A proportional valve 33 is disposed in the conduit connecting the operation device 26 and shuttle valve 32 and is configured to change the flow conduit area of the conduit. In this embodiment, the proportional valve 33 operates in response to control commands output by the controller 30. Therefore, the controller 30 can reduce the pressure of the operating oil discharged by the operation device 26 and supply the oil to the pilot port of the corresponding control valve in the control valve part 17 through the shuttle valve 32 regardless of the operation of the operation device 26 by the operator.

With this arrangement, the controller 30 may activate the hydraulic actuator corresponding to the particular operation device 26 even if no operation is performed on the specific operation device 26. The controller 30 may also forcibly stop the operation of the hydraulic actuator corresponding to the specific operation device 26 even when the operation is performed for the specific operation device 26.

For example, as illustrated in FIG. 6A, the left operation lever 26L is used to operate the arm 5. Specifically, the left operation lever 26L utilizes hydraulic oil discharged by the pilot pump 15 to apply a pilot pressure to a pilot port of the control valve part 176 in response to the operation in the front and back directions. More specifically, when the left operation lever 26L is operated in a direction of closing the arm, the pilot pressure corresponding to the operation amount is caused to act on the right pilot port of the control valve part 176L and to the left pilot port of the control valve part 176R. When the left operation lever 26L is operated in the arm opening direction (forward), the left operation lever 26L acts on the left pilot port of the control valve part 176L and the right pilot port of the control valve part 176R in response to the amount of operation.

The left operation lever 26L is provided with a switch NS. In this embodiment, the switch NS includes a plurality of push-button switches. The switch NS may be formed with a push-button switch. The operator can operate the left operation lever 26L while depressing the switch NS. The switch NS may be provided on the right operation lever 26R or at other position within the cabin 10.

The operation pressure sensor 29LA detects the contents of the operation in the front and back directions relative to the left operation lever 26L by the operator in the form of pressure and outputs the detected value to the controller 30.

The proportional valve 31AL operates in response to a current command output by the controller 30. The pressure of the hydraulic oil introduced from the pilot pump 15 to the right pilot port of the control valve part 176L and the left pilot port of the control valve part 176R through the proportional valve 31AL and shuttle valve 32AL is then adjusted. The proportional valve 31AR operates in response to a current command output by the controller 30. The pressure of the hydraulic oil introduced from the pilot pump 15 to the left pilot port of the control valve part 176L and the right pilot port of the control valve part 176R is adjusted through the proportional valve 31AR and the shuttle valve 32AR. The proportional valves 31AL and 31AR can adjust the pilot pressure so that the control valves 176L and 176R can be stopped at any valve position.

This arrangement allows the controller 30 to supply the hydraulic oil discharged by the pilot pump 15 to the right pilot port of the control valve part 176L and the left pilot port of the control valve part 176R through the proportional valve 31AL and the shuttle valve 32AL, independent of the arm closing operation by the operator. Said different, the arm 5 can be automatically closed. The controller 30 may also supply the hydraulic oil discharged by the pilot pump 15 to the left pilot port of the control valve part 176L and the right pilot port of the control valve part 176R through the proportional valve 31AR and shuttle valve 32AR, regardless of an arm stretch out operation by the operator. That is, the arm 5 can be opened automatically.

The proportional valve 33AL operates in response to a control command (a current command) output by the controller 30. The pilot pressure is then reduced by the hydraulic oil introduced from the pilot pump 15 to the right pilot port of the control valve part 176L and the left pilot port of the control valve part 176R through the left operation lever 26L, the proportional valve 33AL and the shuttle valve 32AL. The proportional valve 33AR operates in response to the control command (a current command) output by the controller 30. The pilot pressure is then reduced by the hydraulic oil introduced from the pilot pump 15 to the left operation lever 26L, the proportional valve 33AR, and the left pilot port of the control valve part 176L and the right pilot port of the control valve part 176R through the shuttle valve 32AR. The proportional valves 33AL and 33AR can adjust the pilot pressure so that the control valves 176L and 176R can be stopped at any valve position.

With this arrangement, the controller 30 can depressurize the pilot pressure acting on the pilot port (the left pilot port of the control valve part 176L and the right pilot port of the control valve part 176R) on the closing side of the control valve part 176 and forcibly stop the closing operation of the arm 5, if necessary, even when an operator is performing an arm closing operation. The same shall apply to the case where the opening operation of the arm 5 is forcibly stopped while an operator is performing the arm opening operation.

Alternatively, the controller 30 controls the proportional valve 31AR, if desired, even if the operator is performing an arm closure operation, to increase the pilot pressure acting on the pilot port (the right pilot port of the control valve part 176L and the left pilot port of the control valve part 176R) on the open side of the control valve part 176 opposite the pilot port on the closed side of the control valve part 176 on the open side of the control valve part 176 opposite the pilot port on the closed side of the control valve part 176. The closing operation of the arm 5 may be forcibly stopped by forcibly returning the control valve 176 to a neutral position. In this case, the proportional valve 33AL may be omitted. The same shall apply to a case in which the arm stretching action is forcibly stopped when the operator performs the arm stretching operation.

Hereinafter, the description while referring to FIGS. 6B to 6D will be omitted. However, the same shall apply to the case of forcibly stopping the swivel of the upper swivel body 3 when the operator performs the swivel operation, the case of forcibly stopping the operation of the boom 4 when a boom-up operation or a boom-down operation is performed by the operator, and the case of forcibly stopping the operation of the bucket 6 when the operator performs the bucket closing operation or the bucket opening operation. The same shall apply to the case where the travelling action of the lower travel body 1 is forcibly stopped when the travel operation by the operator is performed.

As illustrated in FIG. 6B, the left operation lever 26L is also used to operate the swivel mechanism 2. Specifically, the left operation lever 26L utilizes the hydraulic oil discharged by the pilot pump 15 to apply a pilot pressure to the pilot port of the control valve part 173 in response to the operation in the left and right directions. More specifically, the left operation lever 26L causes the left pilot port of the control valve part 173 to be actuated in response to the operation amount when operated in the left swivel direction (the left direction). When the left operation lever 26L is operated in the right swivel direction (the right direction), the pilot pressure in response to the operation amount is applied to the right pilot port of the control valve part 173.

The operation pressure sensor 29LB detects the contents of the operation in the left and right directions relative to the left operation lever 26L by the operator in the form of pressure and outputs the detected value to the controller 30.

The proportional valve 31BL operates in response to a current command output by the controller 30. The pilot pressure is then adjusted by the hydraulic oil introduced from the pilot pump 15 through the proportional valve 31BL and the shuttle valve 32BL to the left pilot port of the control valve part 173. The proportional valve 31BR is actuated in response to the current command output by the controller 30. The pilot pressure is then adjusted by the hydraulic oil introduced from the pilot pump 15 to the right pilot port of the control valve part 173 through the proportional valve 31BR and the shuttle valve 32BR. The proportional valve 31BL, 31BR can adjust the pilot pressure so that the control valve part 173 can be stopped at any valve position.

This structure allows the controller 30 to supply the hydraulic oil discharged by the pilot pump 15 to the left pilot port of the control valve part 173 via the proportional valve 31BL and the shuttle valve 32BL, independent of a left swivel operation by the operator. That is, the swivel mechanism 2 can automatically swivel left. The controller 30 may also supply the hydraulic oil discharged by the pilot pump 15 to the right pilot port of the control valve part 173 through the proportional valve 31BR and the shuttle valve 32BR regardless of the right swivel operation by the user. That is, the swivel mechanism 2 can be automatically swivel to the right.

As illustrated in FIG. 6C, the right operation lever 26R is used to operate the boom 4. Specifically, the right operation lever 26R utilizes the hydraulic oil discharged by the pilot pump 15 to apply a pilot pressure to the pilot port of the control valve part 175 in response to the front and back operations. More specifically, the right operation lever 26R acts on the right pilot port of the control valve part 175L and the left pilot port of the control valve part 175R in response to the operation amount when operated in the boom-up direction (back direction). The right operation lever 26R, when operated in the boom-lowering direction (forward direction), causes the pilot pressure to be applied to the right pilot port of the control valve part 175R according to the amount of operation.

The operation pressure sensor 29RA detects the contents of the operator's forward and backward operation to the right operation lever 26R in the form of pressure and outputs the detected value to the controller 30.

The proportional valve 31CL operates in response to a current command output by the controller 30. From the pilot pump 15 through the proportional valve 31CL and the shuttle valve 32 CL to the right pilot port of the control valve part 175L and the control valve part 175R Adjust the pilot pressure with the hydraulic oil introduced to the left pilot port. The proportional valve 31CR operates in response to a current command output by the controller 30. The pressure of the hydraulic oil introduced from the pilot pump 15 to the left pilot port of the control valve part 175L and the right pilot port of the control valve part 175R is then adjusted through the proportional valve 31CR and the shuttle valve 32CR. The proportional valves 31CL, 31CR can adjust the pilot pressure so that the control valves 175L, 175R can be stopped at any valve position.

This arrangement allows the controller 30 to supply hydraulic oil discharged by the pilot pump 15 to the right pilot port of the control valve part 175L and the left pilot port of the control valve part 175R through the proportional valve 31CL and shuttle valve 32CL, independent of the operator's boom-up operation. That is, the boom 4 can be automatically raised. The controller 30 may also supply hydraulic oil discharged by the pilot pump 15 to the right pilot port of the control valve part 175R through the proportional valve 31CR and the shuttle valve 32CR regardless of the boom-down operation by the operator. That is, the boom 4 can be automatically lowered.

As illustrated in FIG. 6D, the right operation lever 26R is also used to manipulate the bucket 6. Specifically, the right operation lever 26R utilizes the hydraulic oil discharged by the pilot pump 15 to apply a pilot pressure to the pilot port of the control valve part 174 in response to the operation in the left and right directions. More specifically, the right operation lever 26R causes the pilot pressure, depending on the amount of operation, to be applied to the left pilot port of the control valve part 174 when operated in the bucket closing direction (toward the left). The right operation lever 26R, when operated in the bucket opening direction (toward the right), causes the pilot pressure to be applied to the right pilot port of the control valve part 174 in response to the amount of operation.

The operation pressure sensor 29RB detects the contents of the operation by the operator in the left and right directions relative to the right operation lever 26R in the form of pressure and outputs the detected value to the controller 30.

The proportional valve 31DL operates in response to a current command output by the controller 30. The pilot pressure is then adjusted by hydraulic oil introduced from the pilot pump 15 to the left pilot port of the control valve part 174 through the proportional valve 31 DL and shuttle valve 32 DL. The proportional valve 31DR operates in response to a current command output by the controller 30. The pilot pressure is then adjusted by hydraulic oil introduced from the pilot pump 15 to the right pilot port of the control valve part 174 via the proportional valve 3 1DR and the shuttle valve 32DR. The proportional valve 31DL, 3 1DR can adjust the pilot pressure so that the control valve part 174 can be stopped at any valve position.

This arrangement allows the controller 30 to supply hydraulic oil discharged by the pilot pump 15 to the left pilot port of the control valve part 174 via the proportional valve 31DL and shuttle valve 32DL, independent of the operator's bucket closing operation. That is, the bucket 6 can be automatically closed. The controller 30 may also supply hydraulic oil discharged by the pilot pump 15 to the right pilot port of the control valve part 174 through the proportional valve 31DR and shuttle valve 32DR, regardless of the operator's bucket opening operation. That is, the bucket 6 can be opened automatically.

The shovel 100 may be configured to automatically advance and reverse the lower travel body 1. In this case, the hydraulic system portion relating to the operation of the left travel hydraulic motor 2ML and the hydraulic system portion relating to the operation of the right travel hydraulic motor 2MR may be configured in the same manner as the hydraulic system portion relating to the operation of the boom cylinder 7.

Also, although FIGS. 5 and 6A-6D illustrate a hydraulic operation lever having a hydraulic pilot circuit, an electric operation lever rather than a hydraulic operation lever may be employed. In this case, the lever operation amount of the electric operation lever is input to the controller 30 as an electrical signal. A solenoid valve is also disposed between the pilot pump 15 and the pilot port of each control valve. The solenoid valve is configured to operate in response to electrical signals from the controller 30. With this structure, when a manual operation is performed using the electric operation lever, the controller 30 can control the solenoid valve by the electrical signal corresponding to the lever operation amount to increase or decrease the pilot pressure to move each control valve. Each control valve may be famed with an electromagnetic solenoid spool valve. In this case, the solenoid spool valve operates in response to electrical signals from the controller 30 corresponding to the level of lever operation of the electrical operation lever.

Figure 7:
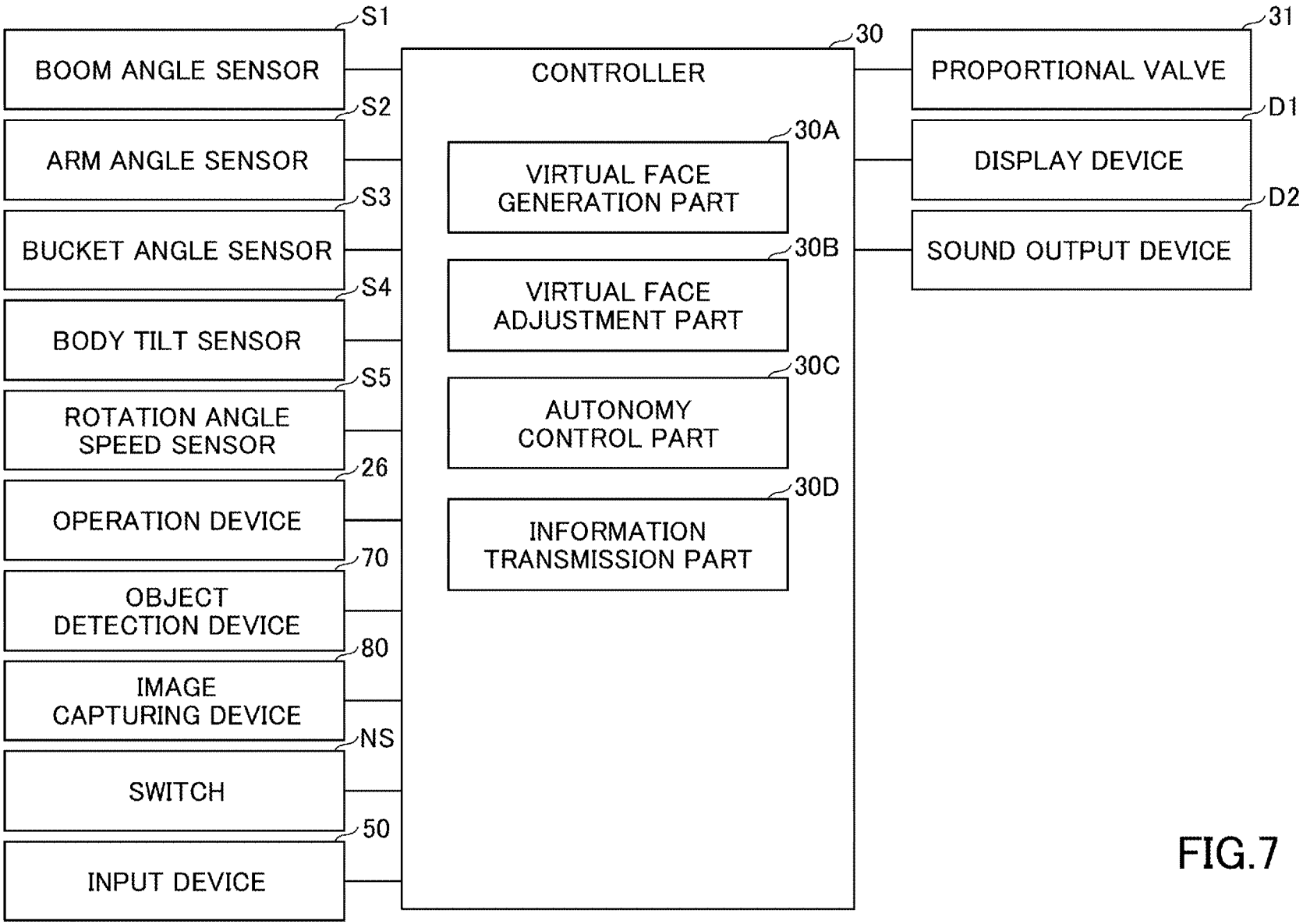
FIG. 7 is a diagram illustrating an example of a configuration of a controller installed on the shovel.

Next, the functions of the controller 30 will be described with reference to FIG. 7. FIG. 7 is a diagram illustrating an example of the structure of the controller 30. In the example of FIG. 7, the controller 30 is configured to receive signals output by the posture detecting device, the operation device 26, the object detection device 70, the image capturing device 80, the switch NS, and the input device 50 perform various calculations and output control commands to the proportional valve 31, the display device D1, and the sound output device D2. The posture detecting device includes at least one from the boom angle sensor S1, the arm angle sensor S2, the bucket angle sensor S3, the body tilt sensor S4, and a swivel angle speed sensor S5. The controller 30 includes a virtual plane generation part 30A, a virtual plane adjustment part 30B, an autonomy control part 30C, and the information transmission part 30D as a functional block. Each function block may be implemented by hardware or software.

The virtual plane generation part 30A is configured to generate the virtual plane VS. The virtual plane VS is a surface that is virtually installed to delimit a working range of the shovel 100. In this embodiment, the virtual plane generation part 30A generates the virtual plane VS based on one or more virtual points VP identified by the operator of the shovel 100 moving the excavation attachment AT. The virtual plane generation part 30A, for example, is a predetermined portion of the excavation attachment AT (e.g., the claw edge of the bucket 6) illustrated in Fig. The virtual rectangular plane through the three virtual points VP specified by (1) is generated as the virtual plane VS. In this case, the rectangular plane has two vertices of two virtual points VP of the three virtual points VP and one side passing through the other virtual point VP. This one side does not pass through the above two vertices. By using this virtual plane VS, the controller 30 can prevent the claw edge of the bucket 6 from crossing during the subsequent work.

The virtual plane adjustment part 30B is configured so that the virtual plane VS generated by the virtual plane generation part 30A can be adjusted, that is, information on the virtual plane VS can be changed. In this embodiment, the virtual plane adjustment part 30B is configured to change the position, size, shape, and slope of the virtual plane VS in response to a control command input through the input device 50. The virtual plane VSA illustrated in FIG. 3B is the virtual plane VS after the adjustment by the virtual plane adjustment part 30B is performed.

The autonomy control part 30C is configured to activate the shovel 100 autonomously. In this embodiment, the autonomy control part 30C is configured to control the movement of the actuator when a predetermined condition is satisfied. For example, "when the predetermined condition is satisfied" may be "when the distance between the virtual plane VS generated by the virtual plane generation part 30A or the virtual plane VSA adjusted by the virtual plane adjustment part 30B and the predetermined portion of the excavation attachment AT (for example, the claw edge of the bucket 6) is less than the predetermined value". For example, when the excavation attachment AT is operated, when the distance between the virtual plane VS and a predetermined portion of the excavation attachment AT is less than a predetermined value, the autonomy control part 30C may output a control command to the proportional valve 33 (see FIGS. 6A to 6D) and automatically control the movement of the excavation attachment AT.

For example, the autonomy control part 30C may output a control command to the proportional valve 33AR (see FIG. 6A) and automatically slow down the opening speed of the arm 5 when the distance between the virtual plane VS and the claw edge of the bucket 6 is less than a predetermined value during the left operation lever 26L is being operated in the arm opening direction. In this case, the autonomy control part 30C may automatically slow down the opening speed of the arm 5 so that the smaller the distance between the virtual plane VS and the claw edge of the bucket 6, the slower the movement of the arm 5. The autonomy control part 30C may stop the movement of the arm 5 when the distance between the virtual plane VS and the claw edge of the bucket 6 is zero during the left operation lever 26L is being operated in the arm opening direction.

Alternatively, the autonomy control part 30 may prevent the claw edge of the bucket 6 from entering the entry-prohibited region defined by the virtual plane VS.

For example, the autonomy control part 30C may automatically operate a member other than the arm 5, such as the boom 4 or the bucket 6, so that the distance between the virtual plane VS and the claw edge of the bucket 6 is not less than a predetermined value when the left operation lever 26L is operated in the arm opening direction. For example, the autonomy control part 30C may automatically raise the boom 4 or automatically close the bucket 6 when the arm 5 is open in response to an operator's lever operation to prevent the claw edge of the bucket 6 from entering the entry-prohibited region.

The information transmission part 30D is configured to communicate various information to the operator of the shovel 100. In this embodiment, the information transmission part 30D is configured to communicate, for example, the size of the distance between the claw edge of the bucket 6 and the virtual plane VS to the operator of the shovel 100. The information transmission part 30D is configured to communicate the size of the distance between the claw edge of the bucket 6 and the virtual plane VS to an operator of the excavator, for example, by using visual information and auditory information.

For example, the information transmission part 30D may communicate to the operator the magnitude of the distance using an intermittent noise generated by the sound output device D2. In this case, the information transmission part 30D may shorten the interval of intermittent sounds as the distance decreases. The information transmission part 30D may use a continuous sound to indicate the magnitude of the distance. In addition, the information transmission part 30D may change the pitch or pitch of the sound or the like to indicate a difference in the distance magnitude. When the distance is less than a predetermined value, the information transmission part 30D may issue an alarm. An alarm is, for example, a continuous sound that is significantly louder than the intermittent sounds.

The information transmission part 30D may provide the display device D1 with the size of the distance between the claw edge of the bucket 6 and the virtual plane VS as the work information. In this case, for example, the display device D1 may display the work information received from the information transmission part 30D together with the image data received from the image capturing device 80 on the screen. For example, the information transmission part 30D may report the size of the distance using an image of an analog meter, an image of a bar graph indicator, or the like to the operator.

Figure 8:
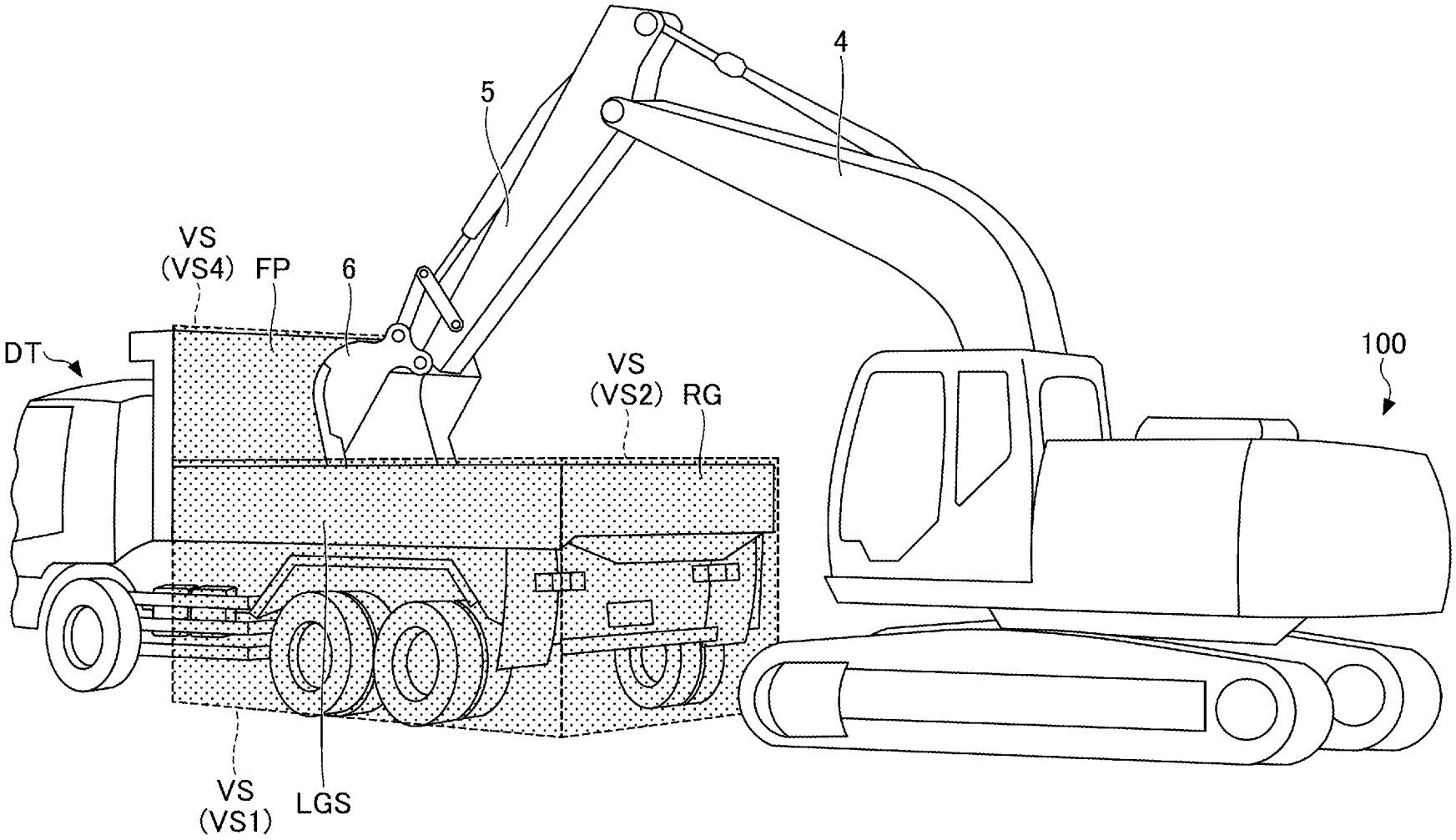
FIG. 8 is a diagram illustrating the worksite where loading works are performed.
Figure 9:
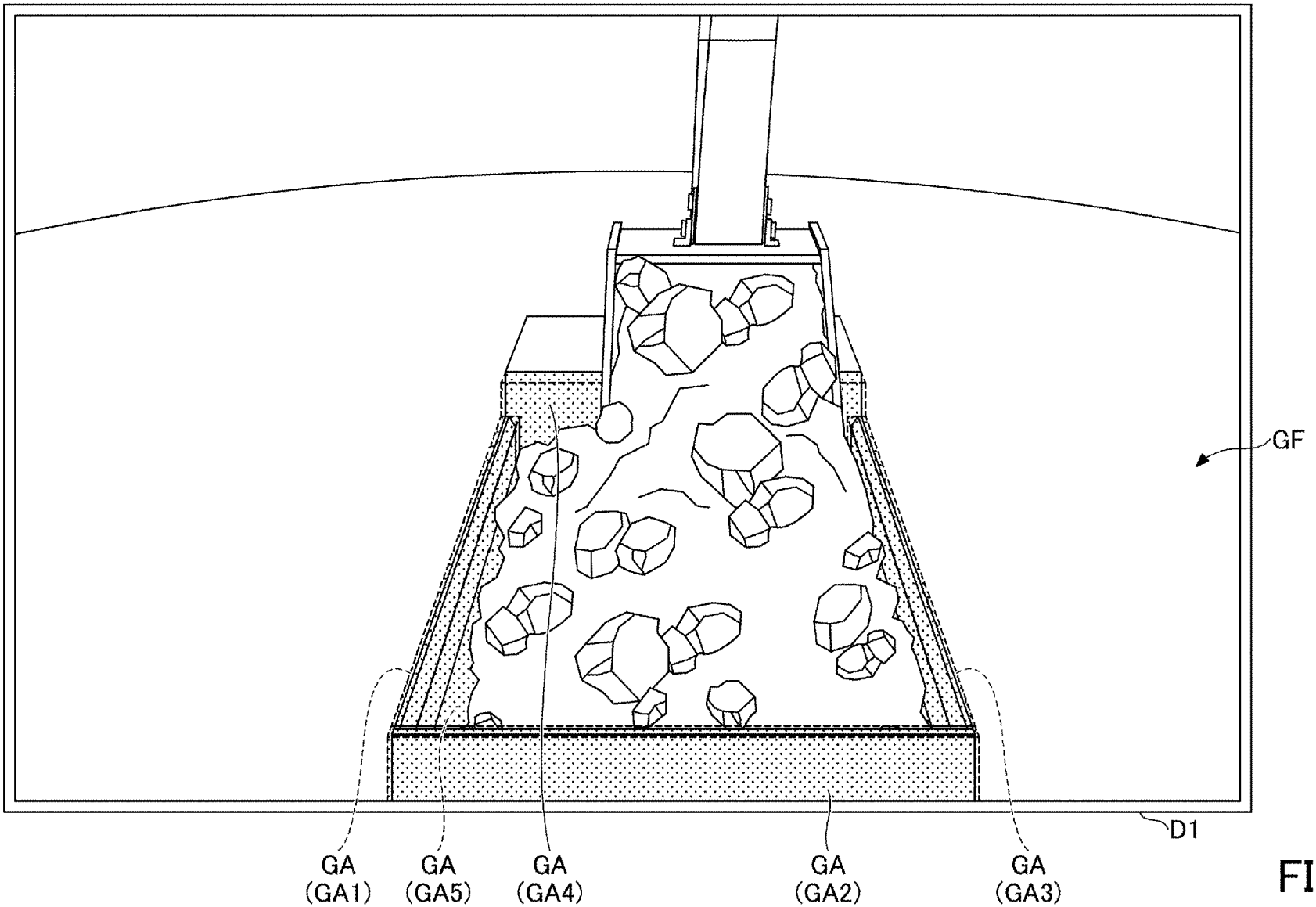
FIG. 9 is an example of an image displayed on the screen of the display device.

Referring now to FIGS. 8 and 9, a virtual plane VS generated when a shovel 100 loads soil onto a dumper truck DT bed will be described. FIG. 8 shows a worksite where loading works are performed. In the loading work, the shovel 100 loads earth and sand into the dumper truck DT platform. FIG. 9 shows an example of an image displayed on a screen of a display device D1 installed on a cabin 10 of a shovel 100 illustrated in FIG. 8.

In the example illustrated in FIGS. 8 and 9, the operator of the shovel 100 generates a virtual plane VS for the dumper truck DT. Specifically, the operator generates a first virtual plane VS1 corresponding to the left side of the dumper truck DT, a second virtual plane VS2 corresponding to the rear surface of the dumper truck DT, a third virtual plane VS3 (not visible in FIG. 8) corresponding to the right side of the dumper truck DT, a fourth virtual plane VS4 corresponding to the front panel FP of the dumper truck DT, and a fifth virtual plane VS5 (not visible in FIG. 8) corresponding to the bottom surface of the dumper truck DT. In this case, the entry-prohibited region corresponds to the space occupied by the dumper truck DT.

Each of the first virtual plane VS1 through the fifth virtual plane VS5 is generated based on three virtual points VP identified by the operator of the shovel 100. However, one virtual plane VS may be generated based on four or more virtual points VP. In this case, the operator can easily generate the virtual plane VS having a complex shape such as a pentagon or hexagon. The operator may also generate a virtual polyhedron formed with a plurality of virtual planes VS.

Alternatively, one virtual plane VS may be generated based on two virtual points VP. In this case, one virtual plane VS is generated, for example, as a virtual plane perpendicular to the virtual horizontal plane and passing through two virtual points VP. The virtual plane VS may be generated to be perpendicular to the virtual plane including the ground plane of the lower travel body 1 rather than the virtual horizontal plane.

Alternatively, one virtual plane VS may be generated based on one virtual point VP. In this case, the one virtual plane VS is parallel to the virtual reference plane and passing through one virtual point VP, for example. The virtual reference plane is, for example, a first virtual plane including the left and right axes and the swivel axes of the upper swivel body 3, a second virtual plane including the front and rear axes and the swivel axes of the upper swivel body 3, or a third virtual plane including the ground plane of the lower travel body 1. The virtual reference plane may be a virtual plane relative to the dumper truck DT such as a side or back surface of the dumper truck, a bottom surface of the bed of the dumper truck DT, or a virtual plane parallel to the surface of the front panel FP. The shape and size of the virtual plane relative to the dumper truck DT may be previously stored in a non-volatile storage device or the like, and may be dynamically generated to match the shape and size of the actual dumper truck DT based on the output of at least one from the object detection device 70 and the image capturing device 80. The virtual plane for the dumper truck DT may be configured to be adjustable via the input device 50.

In the example of FIG. 8, the operator of the shovel 100 identifies the one virtual point VP by bringing the claw edge of the bucket 6 closer to the front panel FP of the dumper truck DT, thereby creating a virtual plane of a predetermined size including the one virtual point VP and parallel to the first virtual plane. The operator adjusts the generated virtual plane to generate the fourth virtual plane VS4 corresponding to the front panel FP of the dumper truck DT.

Similarly, the operator identifies the one virtual point VP by bringing the claw edge of the bucket 6 closer to the left side gate LSG of the dumper truck DT to generate a virtual plane of a predetermined size including the one virtual point VP and parallel to the second virtual plane. The operator adjusts the generated virtual plane to generate the first virtual plane VS1 corresponding to the left side surface (left side gate LSG) of the dumper truck DT. The second virtual plane VS2 corresponding to the back surface of the dumper truck DT (rear gate RG), the right side of the dumper truck DT (right side gate). The second virtual plane VS2 corresponding to the back surface of the dumper truck DT (rear gate RG), the right side of the dumper truck DT (right side gate), and the fifth virtual plane VS5 corresponding to the bottom surface of the dumper truck DT bed are similarly generated.

The first virtual plane VS1 corresponding to the left side of the dumper truck DT (left side gate LSG) may be generated to have a thickness greater than the thickness of the left side gate LSG. That is, the first virtual plane VS1 may be generated as a rectangular body including the left side gate LSG. The thickness may be a predetermined value or a value dynamically input via the input device 50. In this case, the operator can substantially simultaneously generate a virtual plane for preventing the bucket 6 from contacting the outside surface of the left side gate LSG and a virtual plane for preventing the bucket 6 from contacting the inside surface of the left side gate LSG. The same applies to the second virtual plane VS2 and the third virtual plane VS3.

For example, when specifying a virtual point VP, the operator may generate a virtual plane parallel to the first virtual plane by pressing one of the plurality of switches NS as the decision button, generate a virtual plane parallel to the second virtual plane by pressing another of the plurality of switches NS, and generate a virtual plane parallel to the third virtual plane by pressing another of the plurality of switches NS.

Alternatively, the operator may input a distance from the virtual reference plane via the input device 50 to generate the virtual plane VS. In this case, the operator need not move the drilling attachment to identify the virtual point VP. For example, by inputting the distance from the second virtual plane (the distance in the direction parallel to the left and right axis of the upper swivel body 3), the operator generates the first virtual plane VS1 corresponding to the left side gate LSG and the third virtual plane VS3 corresponding to the right side gate, and inputs the distance from the first virtual plane (the distance in the direction parallel to the front and rear axis of the upper swivel body 3). The second virtual plane VS2 corresponding to the rear gate RG and the fourth virtual plane VS4 corresponding to the front panel FP may be generated, and the distance from the third virtual plane (the distance in the direction parallel to the swivel axis) may be input to generate the fifth virtual plane VS5 corresponding to the bottom surface of the loading platform. The operator may also adjust the generated virtual plane VS through the input device 50.

In this manner, by generating one or more virtual planes VS, the operator can set the space occupied by the dumper truck DT as an entry-prohibited region and prevent the bucket 6 from contacting the dumper truck DT during a loading work.

As illustrated in FIG. 9, the display device D1 displays the image GF captured by the front camera 80F installed on the front end of the top surface of the cabin 10. The display device D1 superimposes the image GA of the virtual plane VS generated as described above on the image GF captured by the front camera 80F.

Specifically, the display device D1 superimposes image GA1 of the first virtual plane VS1 corresponding to the left side of the dumper truck D T (the left side gate LSG), image GA2 of the second virtual plane VS2 corresponding to the rear surface of the dumper truck DT (rear gate RG), image GA3 of the third virtual plane VS3 corresponding to the right side of the dumper truck D T (right side gate), image GA4 of the fourth virtual plane VS4 corresponding to the front panel FP of the dumper truck DT, and image GA5 of the fifth virtual plane VS5 corresponding to the bottom surface of the dumper truck DT on the image GF.

When the operator of the shovel 100 watches this screen, the operator can perform the loading work after confirming that the five virtual planes VS are set to the proper position, that is, after confirming that the functions to prevent contact between the excavation attachment AT and the dumper truck DT are properly performed.

Figure 10A:
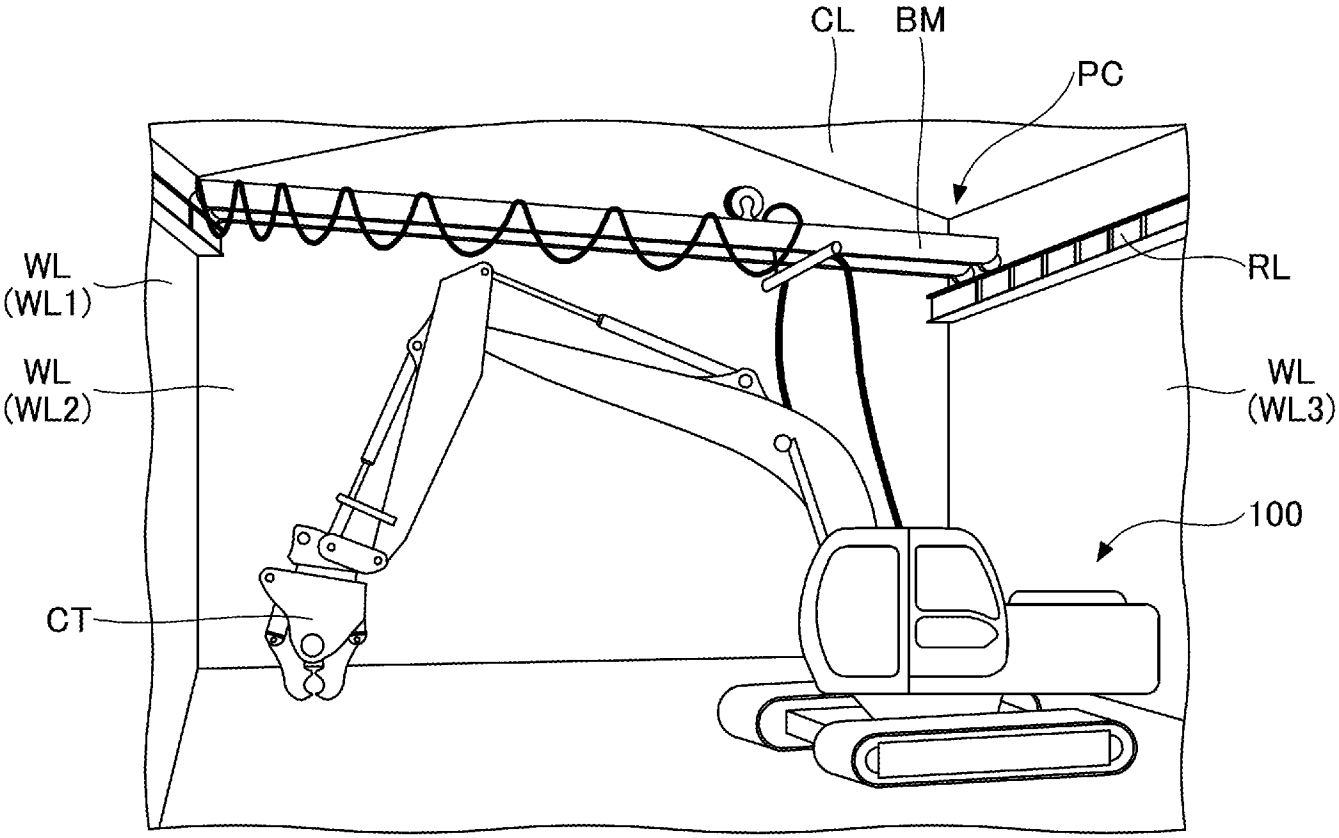
FIG. 10A illustrates the worksite where a dismantling work is performed.
Figure 10B:
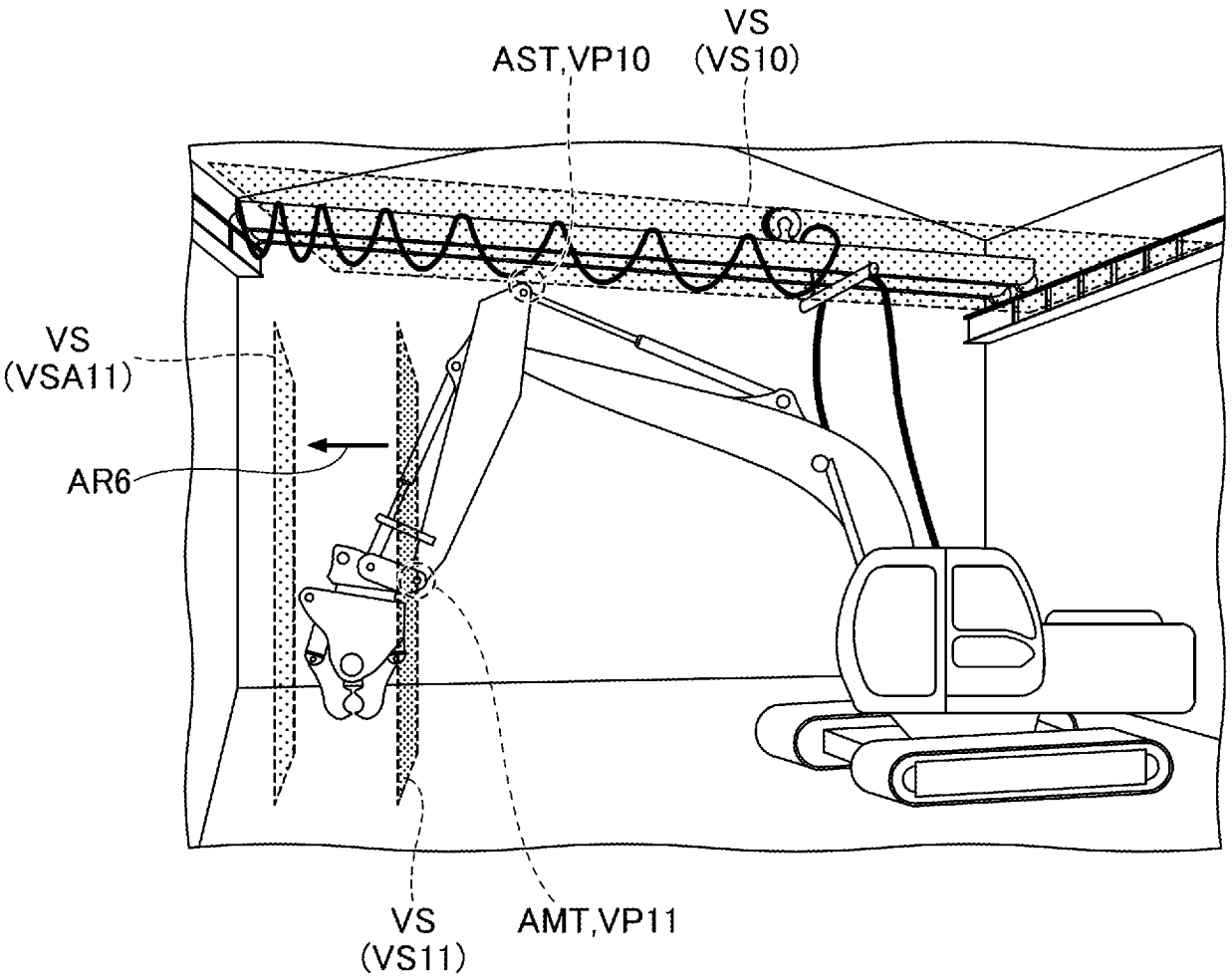
FIG. 10B illustrates the work site where the dismantling work is performed.

Next, with reference to FIGS. 10A and 10B, the virtual plane VS generated when the shovel 100 performs a dismantling work such as an automobile indoors will be described. FIGS. 10A and 10B illustrate a worksite where a dismantling work is performed. The shovel 100 illustrated in FIGS. 10A and 10B is a shovel for dismantling work and a cutter CT is attached to the end of the arm 5 as the end attachment. Specifically, FIG. 10A illustrates the state of the worksite before the virtual plane VS is generated, and FIG. 10B illustrates the state of the work site after the virtual plane VS is generated. In this case, any portion of the cutter CT (e.g. top edge) may be set as the predetermined portion.

The site where the dismantling work is performed is surrounded by a wall WL and covered with a ceiling CL. In addition, a ceiling crane PC is installed indoors. The beam BM of the ceiling crane PC is configured to move over the rail RL located on each of the first and third walls WL1 and WL3.

In the example of FIGS. 10A and 10B, the beam BM of the ceiling crane PC is located at a height capable of contacting the disassembling attachment, which is an example of the attachment of the shovel 100. That is, the highest point of the disassembling attachment when the boom 4 is raised to maximum is higher than the bottom surface of the beam BM of the ceiling crane PC. The disassembling attachment includes the boom 4, arm 5, and a cutter CT. The disassembling attachment may include a grapple, breaker, ripper, grab bucket or the like as an end attachment instead of a cutter CT.

The shovel 100 is also disposed in a space surrounded by a wall WL. Therefore, the first and third walls WL1 and WL3 are in a position in which they can be in contact with a cutter CT. That is, the width between the first wall WL1 and the third wall WL3 is less than the width of the working range of the shovel 100. For example, the working range of the shovel 100 is represented by a circle having a radius from the swivel axis to the front end of the cutter CT when the disassembling attachment is extended to the maximum length.

Therefore, if the actuator movement is not restricted, the operator of the shovel 100 may contact the cutter CT with the wall WL or contact the boom 4 or arm 5 with the beam BM of the ceiling crane PC.

Therefore, the operator of the shovel 100 can prevent contact between the shovel 100 and the beam BM of the wall WL or the ceiling crane PC by defining an entry-prohibited region using the virtual plane VS.

Specifically, the operator of the shovel 100 depresses the switch NS to specify a virtual point VP10 when the boom 4 is raised to bring the upper end point AST of the arm cylinder up to a desired height. The desired height is lower than, for example, the bottom surface of the beam BM of the ceiling crane PC, for example.

In this case, the virtual plane generation part 30A of the controller 30 generates the virtual plane VS10 parallel to the virtual horizontal plane passing through the virtual point VP10. As a result, the space above the virtual plane V S10 is set as an entry-prohibited region.

Here, when the shovel 100 performs an indoor operation, a positioning device (e.g., GNSS receiver) may not be able to receive a GNSS signal. In this case, for example, the controller 30 detects a specific fixed position (for example, a position relative to an installation, such as a clock installed on a wall or corner of a wall) indoors based on the output of the object detection device 70 and sets the fixed position as a reference position (reference point) to generate a local coordinate system. For example, the controller 30 generates a local coordinate system whose origin is its fixed position. The controller 30 calculates a relative position of the shovel 100 (coordinates in the local coordinate system) or a relative position of a cutter CT relative to a reference position, which is a fixed position detected based on the output of the object detection device 70, for example. Therefore, the controller 30 can set the position of the virtual point VP10 and the position of the virtual plane VS10 as the relative position to the reference position. This allows the controller 30 to detect proximity of the cutter CT to the virtual plane V S10 at the front end of the cutter CT based on the relative position of the cutter CT relative to the reference position. In addition, the reference position (reference point) may be set for more than one position in the same worksite. Accordingly, even when a single reference position cannot be detected due to the travelling action of the shovel 100 or the swivel action (when one reference position is not within the detection range of the object detection device 70), the controller 3 can realize a stable braking control by detecting other reference positions. The braking control based on the relative position between a set reference position and a given position can be applied to outdoor works as well as indoor works. In the outdoor works, a specific fixed position (reference position) may be, for example, a position of an installation such as a tower, cabin, or utility pole.

The operator of the shovel 100 also depresses the switch NS to identify the virtual point VP11 when the disassembling attachment is moved from the arm top end point AMT to the desired position. The desired location is, for example, some distance away from the first wall WL1. A certain distance is sufficient to ensure that the cutter CT does not contact the first wall WL1, no matter how the cutter CT is rotated or opened or closed with the arm top end point AMT fixed.

In this case, the virtual plane generation part 30A of the controller 30 generates the virtual plane VS11 parallel to the virtual vertical plane passing through the virtual point VP11. The virtual vertical plane is, for example, a virtual plane parallel to the first wall WL1. As a result, the space between the virtual plane VS11 and the first wall WL1 is set as the entry-prohibited region. In this case, the entry-prohibited region means the region where the entry of the arm top end point AMT is prohibited rather than cutter CT.

The virtual plane generation part 30A may generate the virtual plane VSA11 by offsetting the virtual plane VS11 in a direction represented by an arrow AR6 (a direction approaching the first wall WL1). The offset distance is, for example, the radius of the circle representing the working range of the cutter CT centered on the arm top end point AMT. In this case, the virtual plane generation part 30A can set the space between the virtual plane VSA11 and the first wall WL1 as an entry-prohibited region. In this case, the area in which entry of the cutter CT is prohibited means the area in which the entry is prohibited. In the example of FIGS. 10A and 10B, the offset distance is input manually via a hardware button or input by a touching operation. However, in the non-volatile storage device, the offset distance may be previously stored for each type of the end attachment installed on the front end of the arm 5. The size of the working range of one end attachment (e.g., the cutter CT) is different from that of another end attachment (e.g., grapple). In this case, information regarding the type of the end attachment that is currently installed on the front end of the arm 5 may be previously input via the input device 50.

Figure 11:
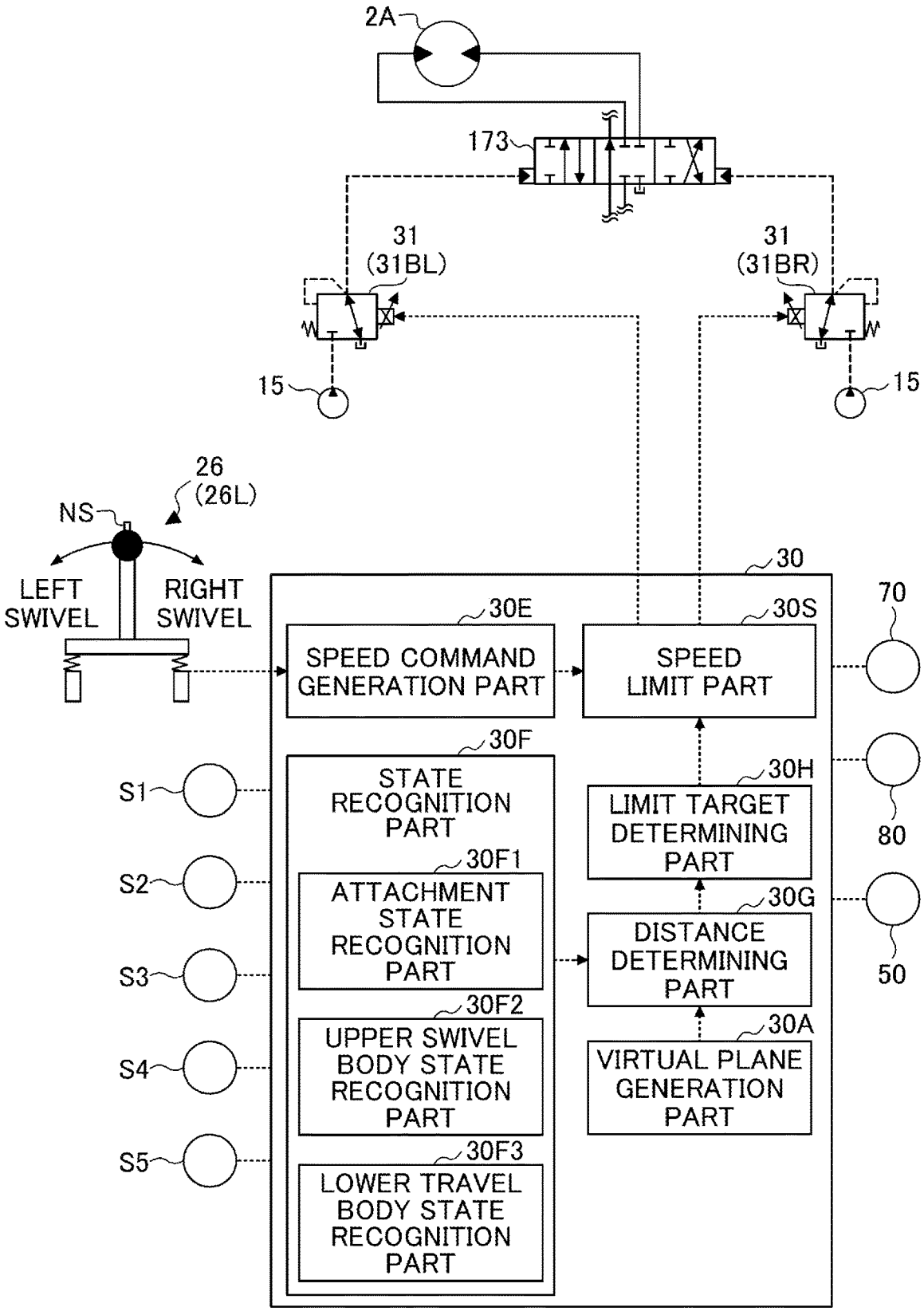
FIG. 11 is a diagram illustrating another example of the configuration of the controller.

Next, another configuration example of the controller 30 will be described with reference to FIG. 11. The controller 30 may also include a virtual plane adjustment part 30B. FIG. 11 is a diagram illustrating another configuration example of a controller 30.

In the example illustrated in FIG. 11, the controller 30 includes a virtual plane generation part 30A, a speed command generation part 30E, a state recognition part 30F, a distance determining part 30G, a limit target determining part 30H, and a speed limit part 30S as functional blocks. Then, the controller 30 operates the boom angle sensor S1, the arm angle sensor S2, the bucket angle sensor S3, the body tilt sensor S4, the swivel angle speed sensor S5, and the left operation lever 26L as the electric operation lever, the input device 50, the object detection device 70, and the image capturing device 80 are configured to receive the signal output by image capturing device 80 perform various calculations, and outputs a control command to the proportional valve 31 or the like. The virtual plane generation part 30A activates in the same manner as the virtual plane generation part 30A of the controller 30 illustrated in FIG. 7. The controller 30 may include a virtual plane adjustment part 30B.

The speed command generation part 30E is configured to generate a command regarding the operation speed of the actuator based on the signal output by the operation device 26. In the example illustrated in FIG. 11, the speed command generation part 30E is configured to generate a command regarding the rotation speed of the swivel hydraulic motor 2A based on the electrical signal output by the left operation lever 26L operated in the left and right directions.

Although the left operation lever 26L illustrated in FIG. 11 is mounted in the cabin 10, It may be located outside of the cabin 10. That is, the left operation lever 26L may be a remote operation lever installed on the remote operation room. In this case, the information is transmitted from the left operation lever 26L to the controller 30 via radio communication. However, the controller 30 and the input device 50 may be provided in the remote operation room with the left operation lever 26L. In this case, the information is transmitted and received between the controller 30 and the posture detecting device, the proportional valve 31, the object detection device 70, and the image capturing device 80 via radio communication. The same applies to the left travel lever 26DL, the right travel lever 26DR, and the right operating lever 26R, which are electric operation levers.

The state recognition part 30F is configured to recognize the present state of the shovel 100. Specifically, the state recognition part 30F includes an attachment state recognition part 30F1, an upper swivel body state recognition part 30F2, and a lower travel body state recognition part 30F3.

The attachment state recognition part 30F1 is configured to recognize the current state of the excavation attachment AT. Specifically, the attachment state recognition part 30F1 is configured to calculate the coordinates of a predetermined point on the outer surface of the excavation attachment AT. A predetermined point includes, for example, all vertices of the excavation attachment AT, for example.

The upper swivel body state recognition part 30F2 is configured to recognize the current state of the upper swivel body 3. Specifically, the upper swivel body state recognition part 30F2 is configured to calculate the coordinates of a predetermined point on the outer surface of the upper swivel body 3. The predetermined point includes, for example, all vertices of the upper swivel body 3.

The lower travel body state recognition part 30F3 is configured to recognize the current state of the lower travel body 1. Specifically, the lower travel body state recognition part 30F3 is configured to calculate the coordinates of a predetermined point on the outer surface of the lower travel body 1. A predetermined point includes, for example, all vertices of the lower travel body 1.

The state recognition part 30F may perform the recognition of any of the three parts (the outer surface of the lower travel body 1, the outer surface of the upper swivel body 3, and the outer surface of the excavation attachment AT) forming the outer surface of the shovel 100 and determine which state is omitted from the recognition depending on the work contents of the shovel 100.

The distance determining part 30G is configured to determine whether or not the distance between each point on the outer surface of the shovel 100 calculated by the state recognition part 30F and the virtual plane VS generated by the virtual plane generation part 30A is less than a predetermined value.

The limit target determining part 30H is configured to determine a target to be limited. In the example illustrated in FIG. 11, the limit target determining part 30H determines an actuator (hereinafter, referred to as the "limit target actuator") to limit movement based on the output of the distance determining part 30G, that is, what point on the outer surface of the shovel 100 and the distance between the virtual plane VS are below a predetermined value.

The speed limit part 30S is configured to limit the action speed of one or more actuators. In the example illustrated in FIG. 11, the speed limit part 30S changes the speed command regarding the actuator determined as the limit target actuator by the limit target determining part 30H among the speed commands generated by the speed command generation part 30E, and outputs the control command corresponding to the speed command after the change to the proportional valve 31.

Specifically, the speed limit part 30S changes the speed command regarding the swivel hydraulic motor 2A determined by the limit target determining part 30H as a limit target actuator, and outputs the control command corresponding to the speed command after the change to the proportional valve 31BL or the proportional valve 31BR. This is to reduce or stop the rotation speed of the swivel hydraulic motor 2A.

With this limit function, the controller 30 illustrated in FIG. 11 can stop the actuator movement to prevent a portion of the body of the shovel 100 body from crossing the virtual plane VS or automatically move the actuator to prevent a portion of the shovel 100 body from crossing the virtual plane VS. To slow down or stop the movement of the actuator can be implemented by a braking control. The braking control means, for example, to adjust the effectiveness of the brake to stop the movement of the actuator.

As described above, the shovel 100 according to an embodiment of the present invention includes a lower travel body 1, an upper swivel body 3 that is pivotably installed on the lower travel body 1, an excavation attachment AT as an attachment installed on the upper swivel body 3, and a posture detecting device that detects a posture of the excavation attachment AT. The shovel 100 is configured to generate a virtual plane VS by using information about the position of the claw edge of the bucket 6, which is a predetermined part of the excavation attachment AT, which is derived from the output of the posture detecting device.

With this arrangement, the shovel 100 can easily generate virtual planes VS that can be used in a variety of applications. The operator of the shovel 100 may, for example, set the desired space as the entry-prohibited region by using one or more virtual planes VS. In this case, the shovel 100 may, for example, slow or stop the attachment so that the attachment does not enter the region where entry is prohibited across the virtual plane VS, or automatically move the attachment to avoid the attachment entering the area where entry is prohibited. Also, if the shovel 100 is a manned shovel, an operator of the shovel 100 can easily generate the virtual plane at any location without leaving the cabin 10.

Thus, the operator of the shovel 100 can easily set the entry-prohibited region according to various conditions without making cumbersome advance preparations. In this respect, the shovel 100 may enhance the safety and efficiency of the work performed by the shovel 100. For example, placement of regulation lines by laser emitted by a dedicated external device and the incorporation of information about obstacles into the construction plan drawings are cumbersome pre-preparations. In the configuration where a virtual plane is generated based on the construction plan including information on the obstacles, the shovel may not be able to prevent contact between the excavation attachment AT and obstacles when there is a misalignment between the position of the obstacle as information included in the construction plan and the position of the obstacle. Therefore, it is necessary for the operator, manager, etc. of such shovel to confirm that there is no misalignment or to update the construction plan drawing when there is such a misalignment. On the other hand, the operator of the shovel 100 is able to generate the virtual plane VS regardless of the construction plan drawing, so that the complicated work such as the above-described confirmation work or the updating work is not required, and the problem caused by the misalignment as described above is not caused. Thus, the shovel 100 can enhance the safety and efficiency of the work performed by the shovel 100.

In addition to the virtual plane VS having an infinite size, the shovel 100 can prevent the work by the shovel 10 from being unduly restricted because the virtual plane VS having a finite size can be easily generated. That is, the shovel 100 prevents another space adjacent to the particular space from being set as the entry-prohibited region when the particular space is set as the entry-prohibited region. In this case, the shovel 100 may permit approach of the attachment to the space adjacent to the particular space while prohibiting entry of the attachment into that particular space set as an entry-prohibited region. Therefore, the shovel 100 can also increase the work efficiency of the shovel 100 at this point.

The virtual plane VS is desirably generated based on three different positions of a predetermined site. For example, as illustrated in FIGS. 3A and 3B, the virtual plane VS may be generated based on three points identified by moving the excavation attachment AT. In the example illustrated in FIGS. 3A and 3B, the three points are point P4, point P4' and point P4" corresponding to the claw edge of the bucket 6.

The shovel 100 is preferably configured to display the virtual plane VS on the screen of the display device D1. The shovel 100 may display the virtual plane VS generated based on the three virtual points VP on the screen of the display device D1, for example, as illustrated in FIG. 4A. With this arrangement, the operator of the shovel 100 can know the real space position of the virtual plane VS that does not exist and can confirm whether the virtual plane VS is generated at the desired position.

The information about the virtual plane VS is configured to be changed by touching operation. For example, the information of the virtual plane VS includes the position, the size, the shape, and the inclination. The tilt is an inclination relative to the virtual horizontal plane or an inclination relative to the virtual vertical plane or the like. The touching operation may be, for example, a tapping operation, a double tapping operation, a swiping operation, a dragging operation or a flicking operation. The touching operation may be a multi touching operation, such as pinch-in operation or pinch-out operation.

The shovel 100 is preferably configured to use a virtual plane VS to define an entry-prohibited region. The shovel 100 may, for example, use five virtual planes VS as illustrated in FIGS. 8 and 9 to define an entry-prohibited region. In the example illustrated in FIGS. 8 and 9, the shovel 100 sets the space occupied by the dumper truck DT as the entry-prohibited region. Alternatively, the shovel 100 may use one virtual plane VS to define an entry-prohibited region, as illustrated in FIGS. 10A and 10B. In the example illustrated in FIGS. 10A and 10B, the shovel 100 sets a space above the bottom surface of the beam BM of the ceiling crane PC as the entry-prohibited region. Further, the shovel 100 sets a space near the wall WL as the entry-prohibited region.

The shovel 100 is preferably configured to slow, stop, or avoid an approach of the excavation attachment AT when it approaches the entry-prohibited region. The shovel 100 is configured to operate the actuator independently of the operation of the operation device 26 by outputting control commands to at least one from the proportional valve 31 and the proportional valve 33, for example, as illustrated in FIGS. 6A to 6D with this arrangement, the shovel 100 can slow down or stop the excavation attachment AT, or it can move the excavation attachment AT to avoid an area that cannot be approached.

The display device D1 is desirably configured to overlap the image of the virtual plane VS, which regulates the entry of shovel 100 on the image captured by the image capturing device 80. The display device D1 may be configured to superimpose the virtual plane VS on the image GF captured by the front camera 80F as illustrated in FIG. 9, for example. The virtual plane VS may be generated based on one or more virtual points identified by moving the attachment, or they may be generated without such virtual points.

The preferred embodiment of the present invention has been described in detail above. However, the invention is not limited to the embodiments described above. Various modifications, substitutions and the like may be applied to the embodiments described above without departing from the scope of the invention. Also, the features described separately may be combined unless there is a technical inconsistency.

DESCRIPTION OF THE SYMBOL

1: lower travel body
1C: crawler
1CL: left crawler
1CR: right crawler
2: swivel mechanism
2A: swivel hydraulic motor
2M: travel hydraulic motor
2ML: left travel hydraulic
2MR: right travel hydraulic motor
3: upper swivel body
4: boom
5: arm
6: bucket
7: boom cylinder
8: arm cylinder
9: bucket cylinder
10: cabin
11: engine
13: regulator
14: main pump
15: pilot pump
17: control valve part
18: choke
19: control pressure sensor
26: operation device
26D: travel lever

26DL: left travel lever
26DR: right travel lever
26L: left operation lever
26R: right operation lever
28L, 28R: discharge pressure sensor
29, 29DL, 29DR, 29LA, 29LB, 29RA, 29RB: operation pressure sensor
30: controller
30A: virtual face generation part
30B: virtual face adjustment part
30C: autonomy control part
30D: information transmission part
30E: speed command generation part
30F: state recognition part
30F1: attachment state recognition part
30F2: upper swivel body state recognition part
30F3: lower travel body state recognition part
30G: distance determining part
30H: limit target determining part
30S: speed limit part
31, 31AL to 31DL, 31AR to 31DR: proportional valve
32, 32AL to 32DL, 32AR to 32DR: shuttle valve
33AR to 33DR: proportional valve
40: center bypass pipe route
42: parallel pipe route
50: input device
70: object detection device
70B: back sensor
70F: front sensor
70L: left sensor
70R: right sensor
70UB: upper back sensor
70UF: upper front sensor
70UL: upper left sensor
70UR: upper right sensor
80: image capturing device
80B: back camera
80F: front camera
80L: left camera
80R: right camera
80UB: upper back camera
80UF: upper front camera
80UL: upper left camera
80UR: upper right camera
100: shovel
171-176: control valve
AMT: arm top bottom point
AST: arm cylinder top bottom point
AT: excavation attachment
BM: beam
CL: ceiling
CT: cutter
DT: display device
D2: sound output device
DT: dumper truck
DW: roadway
FP: front panel
FS: fence
K: rotation axis
LSG: left side gate
NS: switch
PC: ceiling crane
RG: rear gate
RL: rail
S1: boom angle sensor
S2: arm angle sensor
S3: bucket angle sensor
S4: body tilt sensor
S5: rotation angle speed sensor
SW: side walk
VP, VP10, VP11: virtual point
VP1: first virtual point
VP2: second virtual point
VP3: third virtual point
VS, VS10, VS11, VSA, VSA11: virtual plane
VS1: first virtual plane
VS2: second virtual plane
VS3: third virtual plane
VS4: fourth virtual plane
VS5: fifth virtual plane
WL: wall
WL1: first wall
WL2: second wall
WL3: third wall

What is claimed is:

1. A shovel comprising:
a lower travel body;
an upper swivel body that is swingably installed on the lower travel body;
an attachment that is installed on the upper swivel body;
a posture detecting device that detects a posture of the attachment; and
a hardware processor configured to
generate a virtual plane in an area surrounding the shovel by utilizing information about a position of a predetermined portion of the attachment obtained from an output of the posture detecting device, and
control the shovel such that the shovel is prevented from crossing the virtual plane from one side of the virtual plane on which side the shovel is located to an opposite side of the virtual plane from the shovel.

2. The shovel according to claim 1,
wherein the hardware processor is configured to generate the virtual plane is based on three different positions of the predetermined portion.

3. The shovel according to claim 1,
wherein the hardware processor is configured to display the virtual plane on a screen of a display device.

4. The shovel according to claim 1,
wherein the hardware processor is configured to change the information about the virtual plane in response to a touching operation on a display device.

5. The shovel according to claim 1,
wherein the hardware processor is configured to use the virtual plane to define an entry-prohibited region.

6. The shovel according to claim 5,
wherein the hardware processor is configured to slow or stop the attachment or prevent the attachment from entering the entry-prohibited region in response to determining that the attachment approaches the entry-prohibited region.

7. The shovel according to claim 1,
wherein the hardware processor is configured to generate the virtual plane using a local coordinate system based on a standard position that is set in a work site.

8. The shovel according to claim 7,
wherein the hardware processor is configured to slow or stop the attachment or prevent the attachment from entering an entry-prohibited region in response to determining that the attachment approaches the entry-prohibited region, the entry-prohibited region being set by the virtual plane based on the local coordinate system.

9. The shovel according to claim 7, wherein the standard position is a plurality of standard positions and is set in the work site.

10. The shovel according to claim 1, further comprising:

an object detection device that detects an obstacle, wherein the hardware processor is configured to incorporate obstacle information of an obstacle into a construction plan drawing.

11. The shovel according to claim 1, wherein the attachment includes a boom, an arm, and an end attachment as an excavation attachment, the boom being attached to the upper swivel body and rotatably supported relative to the upper swivel body, the arm being attached to an end of the boom and rotatably supported relative to the boom, the end attachment being attached to an end of the arm and rotatably supported relative to the arm.

12. The shovel according to claim 11, wherein the hardware processor is configured to generate the virtual plane based on three different positions of the predetermined portion of the excavation attachment.

13. A display device for a shovel including a lower travel body, an upper swivel body that is swingably installed on the lower travel body, an attachment that is installed on the upper swivel body, a posture detecting device that detects a posture of the attachment, and a hardware processor configured to generate a virtual plane in an area surrounding the shovel by utilizing information about a position of a predetermined portion of the attachment obtained from an output of the posture detecting device, the display device comprising:

a screen that displays an image of the virtual plane over a captured image obtained by using an image capturing device, the virtual plane being generated such that the shovel is controlled to be prevented from crossing the virtual plane from one side of the virtual plane on which side the shovel is located to an opposite side of the virtual plane from the shovel.

14. The display device according to claim 13, wherein the screen is configured to receive a touching operation to change the information about the virtual plane.

15. A control device for a shovel including a lower travel body, an upper swivel body that is swingably installed on the lower travel body, an attachment that is installed on the upper swivel body, and a posture detecting device that detects a posture of the attachment, the control device comprising:

a hardware processor configured to generate a virtual plane in an area surrounding the shovel by utilizing information about a position of a predetermined portion of the attachment obtained from an output of the posture detecting device, and control the shovel such that the shovel is prevented from crossing the virtual plane from one side of the virtual plane on which side the shovel is located to an opposite side of the virtual plane from the shovel.

16. The control device of the shovel according to claim 15, wherein the hardware processor is configured to generate the virtual plane based on three different positions of the predetermined portion.

* * * * *